US005118595A

United States Patent [19]

Ishikawa

[11] Patent Number: 5,118,595

[45] Date of Patent: Jun. 2, 1992

[54] METHOD OF PROCESSING SILVER HALIDE COLOR PHOTOGRAPHIC MATERIAL

[75] Inventor: Takatoshi Ishikawa, Kanagawa, Japan

[73] Assignee: Fuji Photo Film Co., Ltd., Kanagawa, Japan

[21] Appl. No.: 606,722

[22] Filed: Oct. 31, 1990

[30] Foreign Application Priority Data

Nov. 2, 1989 [JP] Japan ..... 1-285029

[51] Int. Cl.[5] ..... G03C 5/35

[52] U.S. Cl. ..... 430/399; 430/434; 430/464; 430/567; 204/94; 204/130; 204/151

[58] Field of Search ..... 430/399, 434, 464, 567; 204/94, 130, 151

[56] References Cited

U.S. PATENT DOCUMENTS

| | | | |
|---|---|---|---|
| 4,046,655 | 9/1977 | Itai et al. | 204/130 |
| 4,089,760 | 5/1978 | Ono | 204/151 |
| 4,145,271 | 3/1979 | Nosse et al. | 204/151 |
| 4,207,157 | 6/1980 | Hirai et al. | 204/180 P |
| 4,283,266 | 8/1981 | Hirai et al. | 204/263 |
| 4,311,574 | 1/1982 | Ishikawa | 204/94 |
| 4,477,563 | 10/1984 | Ichijima et al. | 430/957 |
| 4,686,176 | 8/1987 | Yagi et al. | 430/506 |
| 4,770,990 | 9/1988 | Nakamura et al. | 430/960 |
| 4,775,617 | 10/1988 | Goda et al. | 430/567 |
| 4,914,010 | 4/1990 | Momoki | 430/399 |

OTHER PUBLICATIONS

Patent Abstracts of Japan, vol. 5, No. 81 (p. 63) May 27, 1981 (JP-A-56 027142).

European Search Report, Dec. 1990.

*Primary Examiner*—Hoa V. Le

*Attorney, Agent, or Firm*—Sughrue, Mion, Zinn, Macpeak & Seas

[57] ABSTRACT

A method of processing a silver halide color photographic material while regenerating the color development solution by ion exchange membrane electrodialysis comprising developing an image-wise exposed silver halide photographic material comprising a support having thereon at least one layer of a silver halide emulsion wherein silver halide grains which occupy 50% or more of the projected area of the total of the silver halide grains in the emulsion and which are selected in the order of decreasing aspect ratio from the largest aspect ratio, have an average aspect ratio of 5 or more with a developing solution, and subjecting the development solution to a regeneration using ion-exchange membrane electrodialysis where the equilibrium concentration of bromine ions in the development solution is controlled at a level within the range of $6.0\times10^{-3}$ to $1.3\times10^{-2}$ mol/l.

20 Claims, 3 Drawing Sheets

METHOD OF PROCESSING SILVER HALIDE COLOR PHOTOGRAPHIC MATERIAL

FIELD OF THE INVENTION

The present invention relates to method of processing silver halide color photographic material. More particularly, the invention relates to a continuous processing method in which ion exchange membrane electrodialysis is used to regenerate and re-use a color development solution.

BACKGROUND OF THE INVENTION

The usual practice in processing of silver halide color photographic materials is that used processing solutions are thrown away, generally as overflow solution.

However, these used processing solutions, which are recovered and treated as waste liquid, represent a high environmental pollution burden and are undesirable in terms of protection of the environment. Moreover, the cost of collection and shipment for the purpose of recovery cannot be ignored.

With regard to color development stages for color photographic material in particular, since the solutions concerned are highly alkaline and constitute a considerable organic pollution load as represented by the BOD (biochemical oxygen demand) and the waste liquid represents a large pollution load and since the chemicals are costly, various methods for reducing the amount of waste liquid have been proposed in the past.

For example, low-replenishment processing methods in which compositions of replenishment solutions for color development solutions (referred to below as 'color development replenishment solutions') are adjusted and the amounts of replenishment are reduced are disclosed in JP-A-61-251852 (the term "JP-A" as used herein means an "unexamined published Japanese patent application"), JP-A-61-261741, JP-A-61-282841 and JP-A-61-70552, etc. A procedure one may cite for adjustment of the replenishment solution composition in low-replenishment processing is, e.g., to effect enrichment of consumed components such as the color developer and preservatives, etc. in the replenishment solution so that the necessary amounts of components are supplied even though the amount of replenishment is reduced. When a silver halide color photographic material is processed, halogen ions are released in the color development solution. In low-replenishment processing there is, in particular, an increase in the bromine ion concentration in the color development solution and this results in development inhibition. Therefore, the general practice to prevent this is to take measures to produce the bromide concentration in the replenishment solution so that it is less than it is in an ordinary replenishment processing. However, there is a certain limit even to this, and accumulation of bromine ions causes a slow-down of the progress of development. Further, a delicate variation in the bromine ion concentration causes changes in photographic characteristics, this trend being very marked in processing of a photographic material which has a silver iodobromide emulsion as a main component.

Another procedure that has been considered as a means for reducing waste liquid is the re-use of used processing solution (overflow solution) as replenishment solution. If re-use were possible, it would resolve the above-noted problems relating to waste liquid treatment. Also, since it would make it possible to re-use effective components remaining in the overflow solution, the amount of chemicals used would be less than in the case where replenishment solution is freshly produced. Thus, it would be possible to aim for further reduction of costs. Much research is therefore being conducted on so-called regeneration technology by which, as a regeneration means to make possible the re-use of used processing solution, fluctuations that occur during processing are corrected. The procedure employed generally is to remove accumulated components that have adverse effects on photographic performance while at the same time to add supplementary amounts of components that have been consumed and to use the solution again as a replenishment solution.

A particular problem in the past in regeneration technology has been the question of how to effectively remove accumulated components, and a particularly serious problem in color development stages has been the removal of bromine ions which are dissolved out from photographic material and have a strong development inhibition action.

Halogen removal methods using ion exchange resins have been proposed in, e.g., *SMPTE J.*, 88, 168–171 (1979), JP-A-55-144240 and JP-A-53-132343. However, these methods require large equipment such as a resin column, etc., technology for halogen ion control is needed and batch processing can only be accomplished. Also, regeneration of the resin results in production of large amounts of waste liquid which gives rise to new treatment problems.

JP-B-61-52459 (the term "JP-B" as used herein means an "examined Japanese patent publication") and JP-A-51-97432, etc. disclose halogen removal methods employing ion exchange membrane electrodialysis and JP-A-54-37731 (corresponding to U.S. Pat. No. 4,207,157) and JP-A-56-27142, etc. disclose continuous processing methods in which dialysis and removal are effected in a manner so that the concentrations of halogen ions and particularly of bromine ions in a development solution are kept constant by connecting the development solution tank and an ion exchange membrane electrodialysis tank, detecting and determining the quantity of bromine ions in the development solution and using these data to control the amount of current passed through the electrodialysis tank. A supplementary addition of processing agent components is made to the resulting overflow solution and thus solution is then used again as a replenishment solution. U.S. Pat. No. 4,207,157 discloses to continuously process a silver halide photographic material employing ion exchange membrane electrodialysis while conducting removal of a halogen. However, it does not teach how to stabilize sensitivity and gradation.

Since ion exchange membrane electrodialysis makes continuous operations possible and also makes halogen ion adjustment possible, it has the advantages that handling is easier than in ion exchange resin methods and that only a small amount of equipment space is needed. However, continuous processing using this ion exchange membrane electrodialysis procedure has been associated with the problem that when the halogen ion concentration is controlled to be constant, slight variation in the halogen ion concentration occurs because of variation in the current density, variation in the precision of halogen detection and variation in the concentration of the development solution due to condensation, etc. Thus, fluctuation in the photographic performance achieved (especially sensitivity and gradation) can easily occur, particularly in processing of a silver halide color photographic material.

SUMMARY OF THE INVENTION

Therefore an object of the present invention is to provide a method of processing a silver halide color photographic material which makes it possible to achieve an excellent and stable photographic performance using a waste development solution treatment system employing ion exchange membrane electrodialysis.

It was discovered that the above-noted problems can be solved by a method of processing a silver halide color photographic material while regenerating the color development solution by ion exchange membrane electrodialysis comprising developing an image-wise exposed silver halide photographic material comprising a support having thereon at least one layer of a silver halide emulsion wherein silver halide grains which occupy 50% or more of the projected area of the total of the silver halide grains in the emulsion and which are selected in the order of decreasing aspect ratio from the largest aspect ratio, have an average aspect ratio of 5 or more with a developing solution, and subjecting the development solution to a regeneration using ion-exchange membrane electrodialysis where the equilibrium concentration of bromine ions in the development solution is controlled at a level within the range of $6.0\times10^{-3}$ to $1.3\times10^{-2}$ mol/l.

In particular, when use is made of a photographic material whose coated silver quantity is 2 to 6 g/m$^2$, the dissolved-out halogen ion concentration is in the region which is most easily controlled and an excellent running performance is achieved since photographic variations caused by running processing are stabilized.

There is also little photographic variation accompanying running processing when use is made of a photographic material in which the hydrophilic colloid layer thickness is 23 μm or less.

DETAILED DESCRIPTION OF THE INVENTION

It was found that a stable photographic performance is achieved in a development solution regeneration system using an ion exchange membrane electrodialysis procedure if a color photographic material containing a silver halide emulsion with a high content of specific tabular grains is processed and the bromine ion concentration in the development solution is controlled at a particular level within the range of $6.0\times10^{-3}$ to $1.3\times10^{-2}$ mol/l and preferably is in the range of $8\times10^{-3}$ to $1.2\times10^{-2}$.

Surprisingly, if bromine ion concentration of the development solution in ion exchange membrane electrodialysis is controlled at a concentration that is slightly higher than in the past (which was about 0.005 mol/l), it is possible to suppress slight fluctuations of the halogen ion concentration in the development solution. While not desiring to be found, it is surmized that this is because use of the color photographic material containing the tabular grains of the invention and the fact that the composition of the development solution becomes a comparatively high activity, high development fog inhibition type make it more difficult for variations in the bromine ion concentration to have an effect.

When is meant by the statement that the bromine ion concentration in the development solution is controlled at a level within the range of $6.0\times10^{-3}$ to $1.3\times10^{-2}$ mol/l in the invention is that the set concentration at which the bromine ion concentration should be controlled is one that is within the above-noted range.

Any ion exchange membrane electrodialysis procedure may be effectively employed in the invention as long as it is a waste development solution electrodialysis procedure in which there is provision of apparatus as in the methods described in U.S. Pat. No. 4,207,157, JP-B-52-34939 (corresponding to German Patent (OLS) 2538375), JP-B-61-52459, JP-A-51-84636, JP-A-51-85722, JP-A-51-97432, JP-A-52-119934, JP-A-53-149331, JP-A-53-46732, JP-A-54-9626, JP-A-54-19741, JP-A-53-7234, JP-A-52-146236, JP-A-52-143018 and JP-A-54-58028 by which the bromine ion concentration in the development solution, which is to be regenerated, is measured and the amount of current passed is regulated in a manner so as to bring the development solution's bromine ion concentration to a concentration in the above-noted concentration range.

As an example of an electrodialysis apparatus which may be used, reference is made to JP-A-51-97432. The apparatus is composed of an ion exchange membrane dialysis cell having a number of desalting and concentrating chambers each partitioned alternately by an anion exchange membrane and a cation exchange membrane between an anode and cathode, and the electrodialysis is carried out by pouring developer in the desalting chambers as shown in FIG. 1 of the accompanying drawings.

Figure 1:
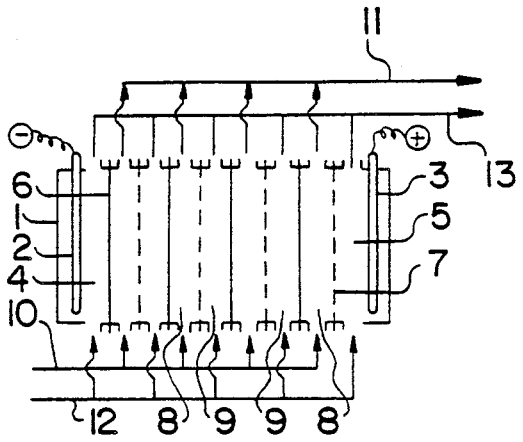
FIG. 1 and FIG. 2 are schematic side views showing an embodiment of the halogen ion removing means used in the present invention.

Thus, in FIG. 1 plural desalting chambers 8 and concentrating chambers 9 (usually, 20 to 100 chambers, respectively) are formed between a cathode 2 and an anode 3 in an ion exchange membrane type dialysis cell 1 by partitioning alternately plural anion exchange membranes 7 and plural cation exchange membranes 6.

A cathodic chamber 4 and an anodic chamber 5 are also formed by partitions of ion exchange membranes disposed adjacent to the cathode and the anode, respectively.

A developer is supplied to each desalting chamber 8 from a supply line 40 and after being electrodialyzed, is discharged through a line 11. An aqueous sodium sulfate solution is supplied to the concentrating chamber 9, the anodic chamber 5 and the cathodic chamber 4 through a supply line 12 and after electrodialysis, is discharged through a lien 13.

The material for the cathode 2 may be iron, nickel, stainless steel, etc., and the material for the anode 3 may be graphite, magnetite, platinum, platinum plated titanium, etc. There is no particular restriction about the cation exchange membranes 6, but anion exchange membranes selectively permeating monovalent anions, in particular bromine ions and iodine ions are desirably used.

The cathodic chamber 4, the anodic chamber 5, and the concentrating chambers 9 are supplied with an aqueous alkali solution such as an aqueous sodium hydroxide solution and an aqueous potassium hydroxide solution, an aqueous solution of a salt such as sodium sulfate, or a solution of an acid such as sulfuric acid. The concentration of these solutions may be about 0.1 normal as the lower limit, and although there is no particular upper limit of the concentration, a sufficient result is usually obtained at a concentration lower than one normal.

A developer is supplied into the desalting chambers 8, which may be connected in parallel as illustrated in FIG. 1 or in series.

When a fatigued developer having a reduced processing faculty is subjected to electrodialysis in the desalting chambers 8, the bromine and iodine ions in the developer transfer through the anion exchange membranes 7 into the concentrating chambers 9 or the anodic chamber 5, through which they are removed from the system. Also, the cations such as, for example, sodium ions, in the developer transfer through the cation exchange membranes 6 into the concentrating chamber 9 or the cathodic chamber 4, through which they are removed from the system. Thus, the concentration of bromine ions, iodine ions, and cations is reduced in the desalting chambers, while the concentration of these ions is increased in the concentrating chambers.

A suitable electrolysis apparatus using an anion exchange membrane is disclosed in JP-A-51-26542. This apparatus is composed of an electrolytic cell having a cathodic chamber and an anodic chamber partitioned by an anion exchange membrane between a cathode and an anode, and a developer to be regenerated is electrolyzed in the cathodic chamber of the cell while an aqueous electrolyte solution is poured in the anodic chamber and a direct current is passed between the two electrodes.

Figure 2:
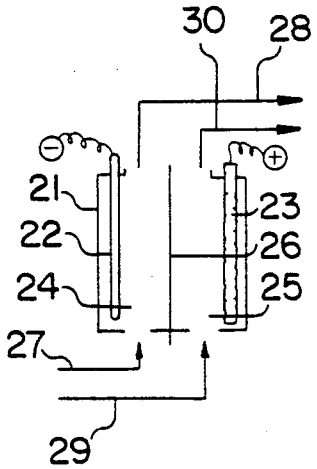

Thus, as shown in FIG. 2, a cathodic chamber 24 and an anodic chamber 25 are formed in an anion exchange membrane electrolytic cell 21 by the partition of an anion exchange membrane 26 disposed in the cell. A developer to be regenerated is supplied to the cathodic chamber from a line 27, an electrolyte solution is supplied into the anodic chamber through a line 29, and the developer is then electrolyzed by passing a direct current between the anode 23 and the cathode 22. The developer thus regenerated by the electrolysis is discharged through a line 28 and the electrolyte solution is discharged through another line 30.

The material for the cathode 22, the anode 23, the anion exchange membrane 26, and the electrolyte solution and concentration may be as described above for the electrodialysis apparatus.

When a fatigued developer having a reduced processing faculty is electrolyzed in the cathodic chamber 24 of the cell, the bromine ions and iodine ions in the developer transfer through the anion exchange membrane 26 into the anodic chamber 25, through which they are removed from the system. Thus, the concentration of these ions is reduced in the cathodic chamber and increased in the anodic chamber.

The apparatus employed is connected to the developer tank of an automatic processor by a conduit or is used individually as a means for removing halogen ions controlled by the signal from the halogen ion determination means.

Figure 3:
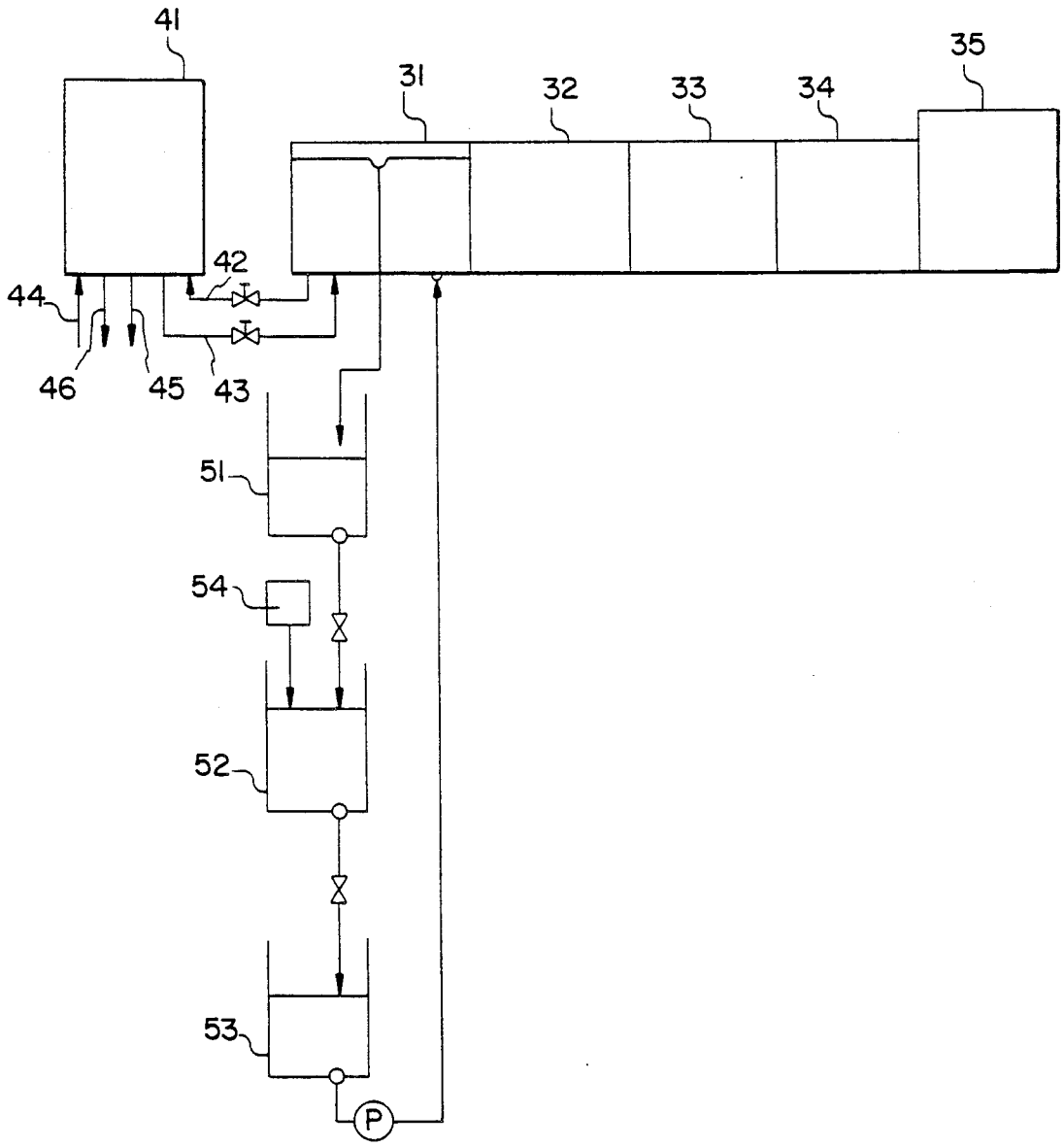
FIG. 3 is a block diagram showing the processing method of the present invention.

In FIG. 3,

31 is a development solution tank,
32 is a bleaching solution tank,
33 is a fixing solution tank,
34 is a water washing and/or stabilization treatment tank,
35 is a drying zone,
41 is an ion exchange membrane electrodialysis regeneration unit
42 and 43 are a supply lines,
44 is a water supply line,
45 is a waste solution line,
46 is a waste water line,
51 is an overflow solution stock tank,
52 is a solution adjustment tank,
53 is a replenishment solution stock tank, and
54 is a regeneration agent storage tank.

Specifically, waste development solution can be regenerated, by connecting the development solution tank 31 of a development unit and the desalting chambers of an ion exchange membrane electrodialysis bath which usually consists of plural anion exchange membranes and plural cation exchange membranes between a cathode and an anode circulating the development solution between the desalting chambers and the development solution tank and passing a quantity of electric current that is so controlled as to make the bromine ion concentration in the development solution constant in accordance with the invention through the electrodialysis bath.

The development solution is supplied to the desalting chambers by a supply line 32 and after going through electrodialysis is discharged via an outflow line 33 and supplied to the development solution tank 31, thereby effecting recirculation of the development solution.

Further, a sodium sulfate solution, etc. is supplied to the concentration chambers and to the anode chamber and cathode chamber via a supply line 34 and after electrodialysis is discharged via an outflow line 35.

Overflow solution of development solution is stocked in stock tank 51, after then the solution is introduced to solution adjustment tank 52, and regeneration agents are supplied thereto from regeneration agent storage tank 54 to prepare regenerated replenishment solution. The thus prepared replenishment solution is introduced to replenishment solution tank 53.

Although the current density varies depending on the ion exchange membrane characteristics and the characteristics of the waste development solution, the current density passed for ion exchange membrane electrodialysis is suitably 0.02 to 10 $A/dm^2$ and preferably it is 0.1 to 3 $A/dm^2$. It is also possible to employ a procedure in which circulation is effected with the electrolyte concentration in the electrolyte solution that is passed through the concentration chambers (the concentration chamber solution) kept constant by supplying an amount of water that corresponds to the amount of development processing into the concentration chamber solution.

As shown in FIG. 3, overflow development solution is stored in an ordinary stock tank 51 and when the stored solution reaches a set amount, it is transferred to a solution adjustment tank 52, components which the solution lacks are added as regeneration agents from a tank 54, a requisite amount of water is added to bring the amount of solution to a specified amount (the adjusted solution quantity) and the resulting solution is transferred to a replenishment solution stock tank 53 and can be re-used as a development replenishment solution.

All the advantages of the regeneration method of the invention are achieved with ordinary development solutions that contain two or more types of ions of bromide ions, chloride ions, sulfate ions, thiocyanate ions, sulfite ions, carbonate ions, phosphate ions, borate ions, nitrate ions, phosphonate ions and bicarbonate ions, etc.

The color development solution that is used in the invention can contain any known aromatic amine color developer. Preferred examples are p-phenylenediamine derivatives, typical examples of which are given below, although the present invention is not restricted to these compounds.

D-1 N,N-diethyl-p-phenylenediamine
D-2 2-amino-5-diethylaminotoluene
D-3 2-amino-5-(N-ethyl-N-laurylamino)toluene
D-4 4-[N-ethyl-N-(β-hydroxyethyl)amino]aniline
D-5 2-methyl-4-[N-ethyl-N-(β-hydroxyethyl) amino]aniline
D-6 4-amino-3-methyl-N-ethyl-N-[β-(methanesulfonamido)ethyl]aniline
D-7 N-(2-amino-5-diethylaminophenylethyl)methanesulfonamide
D-8 N,N-dimethyl-p-phenylenediamine
D-9 4-amino-3-methyl-N-ethyl-N-methoxyethylaniline
D-10 4-amino-3-methyl-N-ethyl-N-β-ethoxyethylaniline
D-11 4-amino-3-methyl-N-ethyl-N-β-butoxyethylaniline Within the above p-phenylenediamine derivatives, the compound noted as example D-5 is particularly preferred.

These p-phenylenediamine derivatives may be salts such as sulfates, hydrochlorides, sulfites or p-toluenesulfonates, etc. The aromatic primary amine color developer is used at a concentration preferably of about 0.1 g to about 20 g, and still more preferably about 0.5 g to about 10 g, per 1 l of color development solution.

A sulfite such as sodium sulfite, potassium sulfite, sodium bisulfite, potassium bisulfite, sodium metasulfite or potassium metasulfite, etc, or carbonyl sulfurous acid adduct may be added as desired to the color development solution as a preservative.

The amount of preservative added is preferably 0.5 to 10 g, and still more preferably 1 to 5 g, per 1 l of color development solution.

Preferably, various types of hydroxylamines, the hydroxamic acids described in JP-A-63-43138, the hydrazines or hydrazides described in Japanese Patent Application No. 61-170756, the phenols described in JP-A-63-44657 and JP-A-63-58443, the α-hydroxyketones or α-aminoketones described in JP-A-63-44656 and/or the various types of saccharides described in JP-A-63-36244 are added as compounds for direct preservation of the aromatic primary amine color developer. It is preferable to use these compounds in combination with monoamines as described in JP-A-63-4235, JP-A-63-24254, JP-A-63-21647, U.S. Pat. No. 4,851,325, JP-A-63-27841 and JP-A-63-25654, etc., diamines as described in JP-A-63-30845, Japanese Patent Application No. 61-164515 and JP-A-63-43139, etc., polyamines as described in JP-A-63-21647 and JP-A-63-26655, polyamines as described in JP-A-63-44655, nitroxy radicals as described in JP-A-63-53551, alcohols as described in JP-A-63-43140 and JP-63-53549, oximes as described in JP-A-63-56654 and tertiary amines as described in EP 0266797A2.

Other preservatives include the various metals described in JP-A-57-44148 and JP-A-57-53749, the salicylic acids described in JP-A-59-180588, the alkanolamines described in JP-A-54-3532, the polyethylenimines described in JP-A-56-94349 and the aromatic polyhydroxy compounds disclosed in U.S. Pat. No. 3,746,544, etc. These may also be present as desired. Addition of aromatic polyhydroxy compounds is particularly preferred.

The pH of the color development solution used in the invention is preferably 9 to 12 and still more preferably it is 9 to 11.0. Other compounds that are known development solution components may be included in the color development solution as described below.

Preferably, various types of buffer agents are used in order to maintain the above-noted pH.

Sodium carbonate, potassium carbonate, sodium bicarbonate, potassium bicarbonate, trisodium phosphate, tripotassium phosphate, disodium phosphate, dipotassium phosphate, sodium, borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-bydroxybenzoate (potassium 5-sulfosalicylate), etc. are specific examples of suitable buffer agents, although the invention is not limited to these compounds.

The amount of these buffer agents added to the color development solution is preferably 0.1 mol/l or more, 0.1 to 0.4 mol/l being particularly preferred.

In addition, various types of chelating agents may be used in the color development solution as calcium or magnesium precipitation preventives and to stabilize the color development solution.

Organic acid compounds are preferred as chelating agents, with suitable examples being aminopolycarboxylic acids, organic phosphonic acids and phosphonocarboxylic acids. Specific examples are given below, although the present invention is not restricted to these examples.

Specific examples include nitrilotriacetic acid, diethylenetriaminepenta-acetic acid, ethylenediaminetetra-acetic acid, N,N,N-trimethylenephosphonic acid, ethylenediamine-N,N,N',N'-tetramethylenephosphonic acid, transcyclohexanediaminetetra-acetic acid, 1,2-diaminopropanetetra-acetic acid, hydroxyethyliminodiacetic acid, glycol ether diaminetetra-acetic acid, ethylenediamineorthohydroxyphenylacetic acid, 2-phosphonobutane-1,2,4-tricarboxylic acid, 1-hydroxyethylidene-1,1-diphosphonic acid and N,N'-bis(2-hydroxybenzyl)ethylenediamine-N,N'diacetic acid.

If desired, two or more of these chelating agents may be used conjointly.

A suitable the amount of these chelating agents added is an amount that is sufficient for sequestering metal ions in the color development solution. For example, the amount is generally about 0.1 to 10 g per 1 l.

A development accelerator may be added to the color development solution if desired. However, from the point of view of environmental pollution characteristics, solution adjustment characteristics and prevention of color staining, it is preferable that the color development solution of the invention contain substantially no benzyl alcohol. What is meant here by 'substantially' is that preferably no benzyl alcohol at all is present, or if it is present, the benzyl alcohol is present at not more than 2 ml per 1 l of development solution.

Other development accelerators that may be added if desired include thioether compounds disclosed in JP-B-37-16088, JP-B-37-5987, JP-B-38-7826, JP-B-44-12380, JP-B-45-9019 and U.S. Pat. No. 3,813,247, etc. the p-phenylenediamine compounds disclosed in JP-A-52-49829 and JP-A-50-15554, the quaternary ammonium salts disclosed in JP-A-50-137726, JP-B-44-30074, JP-A-56-156826 and JP-A-52-43429, etc., the amine compounds disclosed in U.S. Pat. Nos. 2,494,903, 3,128,182, 4,230,796 and 3,253,919, JP-B-41-11431 and U.S. Pat. Nos. 2,482,546, 2,596,926 and 3,582,346, etc. and the polyalkylene oxides disclosed in JP-B-37-16088, JP-B-42-25201, U.S. Pat. No. 3,128,183, JP-B-41-11431, JP-B-42-23883 and U.S. Pat. No. 3,532,501, etc. and also 1-phenyl-3-pyrazolidones and imidazoles, etc.

A fogging preventive may be added in the present invention, if desired. Sodium chloride, potassium bromide, potassium iodide and similar alkali metal halides and organic fogging preventives can be used as fogging preventives. Typical examples of organic fogging preventives that can be employed include nitrogen-containing heterocyclic compounds such as benzotriazole, 6-nitrobenzoimidazole, 5-nitrosoindazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindolidine, and adenine.

The color development solution used in the invention may include a fluorescent brightening agent. 4,4'-Diamino-2,2'-disulfostilbene compounds are preferred as fluorescent brightening agents. The amount added is 0 to 5 g/l and preferably 0.1 to 4 g/l.

Various surfactants such as alkylsulfonic acid, arylsulfonic acid, aliphatic carboxylic acid, aromatic carboxylic acid surfactants may be added too if desired.

The color development solution processing temperature is 20° to 50° C. and preferably 30° to 45° C. The processing time is 20 seconds—5 minutes and preferably 1 minute 30 seconds—4 minutes. It is preferable to have a small replenishment quantity and this quantity is 100 to 2000 ml, more preferably 200 to 1500 ml, and still more preferably 300 to 1000 ml, per 1 $m^2$ of photosensitive material.

The color development solution bath may be divided into two or more baths and replenishment with the development solution replenishment solution may be effected from the first bath or the last bath as a measure for shortening the development time and reducing the replenishment quantity.

The processing method of the invention can also be used for color reversal processing. The black and white development solution used in this case is one which is called a first black and white development solution and which is employed for reversal processing of commonly-known reversal color photographic materials. Well-known additives that are used in black and white development solutions that are employed as solutions for processing black and white photosensitive materials may be included in the first black and white development solution for the color reversal sensitive material.

Representative examples of additives that can be employed are developers such as 1-phenyl-3-pyrazolidone, metal and hydroquinone, preservatives such as sulfites, accelerators including alkalis such as sodium hydroxide, sodium carbonate and potassium carbonate, etc., inorganic or organic inhibitors such as potassium bromide, 2-methylbenzimidazole and methylbenzothiazole, etc., hard water softeners such as polyphosphates and development inhibitors comprising very small amounts of iodides or mercapto compounds.

In the invention, used color development solution (overflow solution) has regeneration agents added to it and is re-used as a color development solution replenishment solution.

In principle, the regeneration agents are added to used color development solution (overflow solution) for the purpose of compensating for components that have been consumed in the color development processing.

In principle, it is preferable that the color development solution replenishment solution regeneration agents used in the invention be the same types of color developers, pH buffers and chelating agents, together with other components, e.g., preservatives, development accelerators and fluorescent brightening agents as desired, which are used initially in the color development solution. All that is needed is to restore the amount of these agents amounts by making up for the consumed components, and the respective amounts are preferably 0.001 to 0.02 moles of color developers 0.01 to 0.2 moles of pH buffer, 0.001 to 0.02 moles of chelating agent and 0.01 to 0.03 moles of preservative, per mol of the regenerated replenishment solution.

Preferably, vaporization of solutions and air oxidation are prevented in the invention by reducing the area of processing tank contact with air. Also, if desired, when the color development solution replenishment solution is prepared, compensation for concentration can be effected by an appropriate supplementary addition of water to make up for the vaporization of the development bath.

Color development is followed by a desilvering treatment in the invention. Typical desilvering processes are noted below, although the present invention is not restricted to these.

| | |
|---|---|
| (1) (Color development) - | bleaching - fixing |
| (2) (Color development) - | bleach-fixing |
| (3) (Color development) - | bleaching - bleach-fixing |
| (4) (Color development) - | fixing - bleach-fixing |
| (5) (Color development) - | bleaching - bleach-fixing - fixing |
| (6) (Color development) - | bleach-fixing - bleaching |
| (7) (Color development) - | bleach-fixing - fixing |

Where the above desilvering processes consist of two or more stages, a water washing or rinse bath can be employed between the two stages. Also, an adjustment, a water washing, adjustment or stop bath can be provided between the color development stage and the desilvering stage.

The treatment baths for bleaching, bleach-fixing and fixing may each be a single bath or may involve two or more treatment baths. Normally, the procedure for replenishment of the various baths is to replenish each bath with a replenishment solution that corresponds to the bath being replenished. If a bleach-fixing bath consists of plural treatment baths, replenishment may be effected by a so-called counterflow system in which replenishment solution is added to the last bath and overflow solution is led to the preceding bath, or by a so-called direct flow system in which replenishment solution is added to the header bath and overflow solution is led to the succeeding bath or baths. In the processes (3) and (4) noted above, overflow solution of the bleaching bath or the fixing bath which is the preceding bath can be led to the bleach-fixing bath so as to replenish the bleach-fixing bath with bleaching components or fixing components. In process (5) above, both the overflow solution of the bleaching bath and the overflow solution of the fixing bath can be led to the bleach-fixing bath. In processes (6) and (7), the components of the bleaching bath or the fixing bath can be led to the bleach-fixing bath.

Compounds of iron (III), cobalt (IV), chromium (VI), manganese (VII), copper (II) and similar polyvalent transition metal ion compounds, peracid compounds, quinones and nitrobenzenes, etc. can be used as bleaching agents in the bleaching bath or bleach-fixing bath of the invention. For example, ferricyanate compounds, dichromates, iron (III) or cobalt (IV) organic acid chelate compounds, ferric chloride, persulfates, hydrogen peroxide, permanganates and benzoquinone, etc. can be used. Of these compounds, use of complex ferric salts of organic acids is preferable from the point of view of environmental pollution characteristics and safety, etc., with use of complex ferric salts of aminopolycarboxylic acids being particularly preferred. Examples of suitable aminopolycarboxylic acids are described below.

1. Ethylenediaminetetra-acetic acid
2. Diethylenetriaminepentaacetic acid
3. Cyclohexanediaminetetraacetic acid
4. 1,2-Propylenediaminetetraacetic acid 5. Ethylenediamine-N-(β-oxyethylene)N,N',N'-triacetic acid
6. 1,3-Diaminopropanametetraacetic acid
7. 1,4-Diaminobutanetetraacetic acid
8. Glycol ether diaminetetraacetic acid
9. Iminodiacetic acid
10. N-methyl-iminodiacetic acid
11. Ethylenediaminetetraproprionic acid
12. N-(2-acetamido)iminodiacetic acid
13. Dihydroxyethylglycine
14. Ethylenediaminediorthohydroxyphenylacetic acid The complex ferric salts of aminopolycarboxylic acids may be used in the form of complex salts or complex ferric ion salts may be formed in a bath solution using ferric salts, e.g., ferric sulfate, ferric chloride, ferric nitrate, ferric ammonium sulfate and ferric phosphate, etc., and aminopolycarboxylic acids. Where they are used in the form of complex salts, one or more complex salts may be used. Where complex salts are formed in a solution using ferric salts and aminopolycarboxylic acids, one or more ferric salts may be used. Also, one or more aminopolycarboxylic acids may be used. In all cases, an amount of aminopolycarboxylic acid in excess of the amount needed to form a complex ferric ion salt may be used.

Metal complex ion salts of metals other than iron, e.g., cobalt and copper, etc., may be included in the bleaching solutions or bleach-fixing solutions containing the above-noted ferric ion complexes.

The amount of bleaching agent added is preferably 0.05 to 1 mole per 1 l of bleaching solution or bleach-fixing solution, with 0.1 to 0.5 moles being particularly preferred.

Rehalogenation agents such as bromides, e.g., potassium bromide, sodium bromide and ammonium bromide, or chlorides, e.g., potassium chloride, sodium chloride and ammonium chloride, etc. may be included in the bleaching bath or bleach-fixing bath of the invention, if desired. Also, one or more inorganic or organic acids or salts thereof that possess a pH buffering function, e.g., nitrates such as sodium nitrate and ammonium nitrate, etc., boric acid, borax, sodium metaborate, acetic acid, sodium acetate, sodium carbonate, potassium carbonate, phosphorous acid, phosphoric acid, sodium phosphate, citric acid, sodium citrate and tartaric acid, etc., can be included.

If required, bleaching accelerators can be used in the bleaching solution or the bleach-fixing solution or their prebaths. Specific examples of bleaching accelerators are described in the following patents and literature: the compounds with mercapto groups or disulfide groups disclosed in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426 and Research Disclosure No. 17129 (July 1978), etc.; the thiazolidone derivatives disclosed in JP-A-50-140129; the thiourea derivatives disclosed in JP-B-45-8506, JP-A-52-20832, JP-A-53-32735 and U.S. Pat. No. 3,706,561; the iodide salts disclosed in West German Patent 1,127,715 and JP-A-58-16235; the polyoxyethylene compounds disclosed in West German Patent 966,410 and 2,748,430; and the polyamine compounds disclosed in JP-B-45-8836. Additionally, the compounds disclosed in JP-A-49-42434, JP-A-49-59644, JP-A-53-94927, JP-A-54-35727, JP-A-55-26506 and JP-A-58-163940 can be used. Of these compounds, compounds with mercapto groups or disulfide groups are preferable since they have great acceleration effects, with particularly preferred compounds being those disclosed in U.S. Pat. No. 3,893,858 West German Patent 1,290,812 and JP-A-53-95630. The compounds disclosed in U.S. Patent 4,552,834 are suitable too. These bleaching accelerators may also be present in the sensitive material. Bleaching accelerators are particularly effective in bleach-fixing of color photographic material for photography.

Thiosulfates, thiocyanates, thioether compounds, thioureas and a large amount of iodide compounds, etc. can be employed as fixing agents for bleach-fixing solutions, but generally thiosulfates are used, with ammonium thiosulfate in particular being employable over the widest range. Preferably, sulfites, bisulfites, carbonyl hydrogensulfite adducts or sulfinic acid products are used as bleach fixing solution preservatives.

There are no particular restrictions regarding the pH of the bleaching solution or bleach-fixing solution in the invention, but it is preferably 3.0 to 8.0 if a complex aminopolycarboxylic acid ferric salt is used as the bleaching agent. The amount of replenishment of the bleaching solution or bleach-fixing solution of the invention must be varied depending on the amount of coated silver of the photographic material that is to be processed. Preferably, the amount of replenishment is from 10 ml to 1000 ml per 1 $m^2$ of photographic material.

The processing method of the invention consists of the above-described color development, bleaching, bleach-fixing, fixing and other stages. Generally, treatments such as washing with water and stabilization, etc. are effected after the bleach-fixing or fixing stage but it is possible to employ a simplified processing method in which treatment in a bath with fixing capability is followed by a stabilization treatment essentially without water washing being effected.

If desired, known additives can be included in the washing water that is used in a water washing stage. For example, hard water softeners such as inorganic phosphoric acids, aminopolycarboxylic acids and organic phosphoric acids, etc., various types of bactericides and antifungal agents for preventing the growth of bacteria and algae (e.g., isothiazolone, organic chlorine-based bactericides and benzotriazole, etc.) and surfactants for preventing drying load and unevenness, etc. can be used. It is also possible to use the compounds described in L. E. West, "Water Quality Criteria", *Phot. Sci. and Eng.*, Vol. 9, No. 6, pages 344 to 359 (1965).

A processing solution that can stabilize dye images can be used as the stabilization solution in the stabilization stage. For example, a solution with a pH 3 to 6 buffering capability or a solution containing an aldehyde (e.g., formaldehyde), etc. can be used. If desired, an ammonium compound, a compound of a metal such as Bi or Al, etc., a fluorescent brightening agent, a chelating agent (e.g., 1-hydroxyethylidene-1,1-diphosphonic acid), bactericides, antifungal agents, film hardening agents, surfactants and alkanolamines, etc. can be used in the stabilization solution.

A multistage counterflow system is preferable for the water washing stage and for the stabilization stage, and the number of stages is preferably 2 to 4. The amount of replenishment per unit area of the photographic material processed is 1 to 50 times and preferably 2 to 30 times and still more preferably 2 to 15 times the amount of solution carried in from the preceding bath.

The water used in the water washing stage or stabilization stage is suitably service water or water that has been deionized to a Ca and Mg concentration of 5 mg/l or less using an ion exchange resin, etc. or water that has been sterilized using a halogen or ultraviolet ray bactericidal lamp, etc.

If processing is effected continuously in an automatic development unit, concentration of the processing solutions due to vaporization can occur in the various color photographic material processing stages, and this is particularly marked when the amount of processed material is small and when the processing solution open area is large. Preferably, replenishment with a suitable amount of water or compensation solutions is conducted in order to compensate for this concentration of the processing solutions.

The amount of waste solution can be reduced by causing the overflow solution of the water washing stage or the stabilization stage to flow into the bath with fixing capability as the preceding bath.

The photographic material in the invention can include at least one silver halide emulsion of a blue-sensitive layer, a green-sensitive layer and a red-sensitive layer on a support, and there are no particular restrictions regarding the number or the order of the silver halide emulsion layers or the non-photosensitive layers of the photosensitive material. A typical example is silver halide photographic material which comprises a support having thereon photosensitive layers comprising a plurality of silver halide emulsion layers which have essentially the same color sensitivity but different speeds. The photosensitive layers are unit photosensitive layers that are sensitive to blue light or to green light or to red light. Generally in multilayer silver halide photographic material, the unit photosensitive layers are provided in the order of the red-sensitive layer, the green-sensitive layer and the blue-sensitive layer from the support. However, depending on purposes, this order may be reversed or the order may be one in which layers that have the same color sensitivity sandwich a layer with a different color sensitivity.

Various types of non-photosensitive layers such as intermediate layers, etc. may be provided between the silver halide photosensitive layers or as the topmost and bottommost layers.

These intermediate layers may contain couplers and DIR compounds, etc. as disclosed in the specifications of JP-A-61-43748, JP-A-59-113438, JP-A-59-113440, JP-A-61-20037 and JP-A-61-20038 and may also contain color mixing preventives, ultraviolet ray absorbents and stain preventives, etc. as are normally employed.

Preferably, a two-layer structure consisting of a high-sensitivity emulsion layer and a low-sensitivity emulsion layer as described in West German Patent 1,121,470 or U.K. Patent 923,045 is used for the plural silver halide emulsion layers that form each unit photosensitive layer. Normally, an arrangement in which the speed gradually decreases towards the support is preferable and non-photosensitive layers can be provided between the various silver halide emulsion layers. Also, a low-speed emulsion layer can be provided on the side that is further from the support and a high-speed emulsion layer on the side that is nearer the support as described in JP-A-57-112751, JP-A-62-200350, JP-A-62-206541 and JP-A-62-206543.

Specific examples include arrangements in which the order going from the support is as follows: low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), BH/BL/GL/GH/RH/RL or BH/BL/GH/GL/RL/RH.

It is also possible to use an arrangement in which, as described in the disclosure of JP-B-55-34932, the order going from the side that is furthest from the support is blue-sensitive layer/GH/RH/GL/RL or an arrangement in which, as described in JP-A-56-25738 and JP-A-62-63936, the order going from the side that is furthest from the support is blue-sensitive layer/GL/RL/GH/RH.

Another arrangement that can be employed is one in which, as described in JP B-49-15495, a silver halide emulsion layer with the fastest speed is the top layer, the middle layer is a silver halide emulsion whose speed is lower than this and the bottom layer is a silver halide emulsion layer whose speed is lower than that of the middle layer. This arrangement thus is one consisting of three layers of successively lower speeds going towards the support. Even where this arrangement of three layers with different speeds is used, layers of given color-sensitivity may comprise layers in the order medium speed emulsion layer/high speed emulsion layer/-low speed emulsion layer going from the side that is further from the support, as described in JP-A-59-202464.

As described above, various layer structures and arrangements can be selected in accordance with the intended purpose of the sensitive material.

Any of these layer arrangements can be used in the color photographic material of the invention.

The swelling ratio of the sensitive material of the invention [((A) equilibrium swelled film thickness at 25° C. in $H_2O$ minus (B) total dry film thickness at 25° C., 55% RH/(B) total dry film thickness at 25° C., 55% RH)$\times$100] is preferably 50 to 200% and still more preferably 70 to 150%. If the swelling ratio deviates from these figures, fluctuation in photographic characteristics tends to occur.

The swelling rate of the sensitive material of the invention is preferably a $T\frac{1}{2}$ of 15 seconds or less and still more preferably it is 9 seconds or less where the swelling rate $T\frac{1}{2}$ is defined as one half the time required to reach 90% of the saturation swelled film thickness in a color development solution (38° C.).

From the point of view of the effects of the invention, the dry film thickness (film thickness after storage for 1 month at 25° C., 60% RH) of the hydrophilic colloid layers (emulsion layers, intermediate layers, antihalation layers, etc.) in the sensitive material of the invention is preferably 23 μm or less and still more preferably it is 20 μm or less, with 18 μm or less being particularly preferred and preferably at least 5 μm.

In the invention, in the emulsion layer specified hereinabove an emulsion having any silver halide composition can be used, and an emulsion containing silver iodobromide, silver bromide, silver chlorobromide, or silver bromochloroiodide is preferred. The higher the average aspect ratio of the silver halide grains employed is, the better their color development characteristics are. The advantages of the invention over emulsions that are used in conventional photographic materials are apparent when the average aspect ratio is 5 or more, or even better 8 or more. The silver halide used in the grains of the invention is more preferably when silver iodobromide has a silver iodide content of 0.1 to 20 mol %. The grains may have different halogen compositions in the internal portions and the surface layers or have different halogen compositions in the center portion and circular peripheral portions.

Further, the grains may also be mixtures of grains comprising multiphase structures and grains with a uniform halogen composition.

The aspect ratio referred to in the invention is defined as the ratio between the diameter when the projected area obtained when opposed parallel principal crystal planes of silver halide grains are projected onto a plane parallel thereto is converted to a circle and the distance between the parallel principal crystal planes, i.e., the grain thickness. If a silver halide grain has no such a crystal plane, the largest projected area of the grain is considered as the projected area in the calculation of the diameter.

A tabular grain means a grain having an aspect ratio of 2 or more. An average aspect ratio means an average of aspect ratios of the total of silver halide grains.

For the above-described grains with an average aspect ratio of 5 or more, the diameter (obtained as described above) of the silver halide grains that are used in the invention is preferably an average of 0.25 to 2.8 μm, with an average of 0.45 to 1.9 μm being particularly preferred. The average grain thickness is 0.56 μm or less and preferably 0.38 μm or less and still more preferably 0.2 μm or less, and preferably at least 0.01 μm.

In the present invention, silver halide grains which occupy 50% or more, preferably 70% or more, more preferably 90% or more, and most preferably 95 to 100% of the total silver halide grains in an emulsion layer and which are selected in the same manner as above, have an average aspect ratio of 5 or more. Silver halide grains used in the emulsion layer of the present invention comprise a large number of tabular silver halide grains. It is also possible to use tabular silver halide grains whose diameter and thickness distributions are narrow. In particular, it is preferable in the invention that the grains have a distribution such that the number of grains having a large grain thickness is not large.

Tabular silver halide emulsions that are used in the invention can be manufactured by mixing solutions of water-soluble silver salts (e.g., silver nitrate) and solutions of water-soluble halogen salts (e.g., potassium bromide or sodium chloride alone or as a mixture thereof) in the presence of a solution of a water-soluble high molecular weight compound such as gelatin.

More specifically, detailed descriptions are given in the following documents: U.S. Pat. Nos. 4,434,226, 4,439,520, 4,414,310, 4,425,425, 4,399,215, 4,435,501, 4,386,156, 4,400,463, 4,414,306, 4,425,426 and 4,433,048, European Patent 84637A2, JP-A-59-99433 and Research Disclosure No. 22534 (January 1983), etc.

A layer of the above-described emulsion containing tabular grains according to the invention is present in at least one layer and preferably in half or more of all the emulsion layers. Preferably, layers containing these tabular grains are used for the blue-sensitive layers and/or the green-sensitive layers and also they are preferably used for a higher-speed layer in a unit of the same color-sensitive layers.

The color photographic material used in the invention may also contain layers of photographic emulsions (non-tabular) other than the above-described tabular emulsion. Preferred silver halides for use as these emulsion layers are silver iodobromide, silver iodochloride and silver iodochlorobromide containing about 0.1 to 30 mol % of silver iodide. A particularly preferred silver halide is silver iodobromide containing from about 2 mol % to about 25 mol % of silver iodide.

Other silver halide grains in the photographic emulsion may be grains with cubic, octahedral, tetradecahedral or similar regular crystals, grains with a spherical, plate-like or similar irregular crystal form of grains in which there are crystal defects such as twin crystal planes or they may be a mixture of grains with a variety of crystal forms.

The silver halide grains other than the specific tabular grains may be micrograins with a grain diameter of about 0.2 microns or less or be large-size grains with a projected area (calculated as a circle) diameter of up to about 10 microns. They may also comprise a polydisperse emulsion or a monodisperse emulsion.

These silver halide emulsions that are also employable in the invention can be prepared by methods such as described in, e.g., *Research Disclosure* (RD) No. 17643 (December 1978), p.22 to 23, *Emulsion Preparation And Types* and *Ibid.*, No. 18716 (November 979), p. 648 and by P. Glafkides, *Chimie et Physique Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964).

Monodisperse emulsions as described in U.S. Pat. Nos. 3,574,628 and 3,655,394 and U.K. Patent 1,413,748, etc. are suitable as well.

Silver halide grains with uniform crystal, grains whose internal portions and external portions have different halogen compositions, grains have a phase-type structure, or grains have silver halides which have different compositions and are bonded by epitaxial bonding or are bonded to compounds other than silver halides, e.g., silver thiocyanate and lead oxide, etc. can be used.

Also, mixtures of grains with various crystal forms may be used.

A coated silver quantity of 2 to 6 g/m$^2$ in the photographic material is particularly preferred in the invention.

Normally, the silver halide emulsions used in the invention are emulsions which have been subjected to physical ripening, chemical ripening and spectral sensitization. Additives used in such stages are described in *Research Disclosure* No. 17643 and No. 18716, and the sections where these additives are described are summarized in the table below.

These two issues of Research Disclosure also disclose known additives for photography that can be used in the invention and the relevant sections where they are described are also set forth in the following table.

| Type of additive | RD17643 | RD18716 |
|---|---|---|
| 1 Chemical sensitizers | p. 23 | p. 648 r.h. col. |
| 2 Sensitivity improvers | | " |
| 3 Spectral sensitizers Supersensitizers | p. 23–24 | p. 648 r.h. col.–p. 649 r.h. col. |
| 4 Brightening agents | p. 24 | |
| 5 Antifoggants and stabilizers | p. 24–25 | p. 649 r.h. col. |
| 6 Light absorbers, filter dyes, UV ray absorbers | p. 25–26 | p. 649 r.h. col.–p. 650 l.h. col. |
| 7 Stain preventives | p. 25 r.h. col. | p. 650 l.h.–r.h. col. |
| 8 Color image stabilizers | p. 25 | |
| 9 Hardeners | p. 26 | p. 651 l.h. col. |
| 10 Binders | p. 26 | " |
| 11 Plasticizers, lubricants | p. 27 | p. 650 r.h. col. |
| 12 Coating assistants, surfactants | p. 26–27 | " |
| 13 Antistatic agents | p. 27 | " |

A variety of color couplers can be used in the invention, and specific examples are described in the patents listed in the above-noted Research Disclosure No. 17643, VII-C to G.

Couplers as disclosed in, e.g., U.S. Pat. Nos. 3,933,501, 4,022,620, 4,326,024, 4,401,752 and 4,248,961, JP-B-58-10739, U.K. Patents 1,425,020 and 1,476,760, U.S. Pat. Nos. 3,973,968, 4,314,023 and 4,511,649 and European Patent 249473A are preferred as yellow couplers.

5-pyrazolones and pyrazoloazole compounds are preferred as magenta couplers, and compounds as disclosed in, e.g., U.S. Pat. Nos. 4,310,619 and 4,351,897, European Patent 73636, U.S. Pat. Nos. 3,061,432 and 3,725,064, RD No. 24220 (June 1984), JP-A-60-33552, RD No. 24230 (June 1984), JP-A-60-43659, JP-A-61-72238, JP-A-60-35730, JP-A-55-118034, JP-A-60-185951 and U.S. Pat. Nos. 4,500,630, 4,540,654 and 4,556,630 and WO (PCT) 88/04795 are particularly preferred.

Phenolic and naphtholic couplers can be employed as cyan couplers, with the materials disclosed in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, Laid-open West German Patent 3,329,729, European Patents 121365A and 249453A, U.S. Pat. Nos. 3,446,622, 4,333,999, 4,753,871, 4,451,559, 4,427,767, 4,690,889, 4,254,212 and 4,296,199 and JP-A-61-42658 being preferred.

The materials as disclosed in RD No. 17643, Item VII-G, U.S. Pat. No. 4,163,670, JP-B-57-39413, U.S. Pat. Nos. 4,004,929 and 4,138,258 and U.K. Patent 1,146,368 are preferred as colored couplers for compensating for unwanted absorption of coupling dyes. Also, the couplers disclosed in U.S. Pat. No. 4,774,181 which compensate for unwanted absorption of coupler dyes by fluorescent dyes that are released at the time of coupling and the couplers disclosed in U.S. Pat. No. 4,777,120 that have elimination groups in the form of dye precursor groups that can form dyes through reaction with developers are preferred.

The compounds disclosed in U.S. Pat. No. 4,366,237, U.K. Patent 2,125,570, European Patent 96570 and West German Patent (laid open) 3,234,533 are preferred as couplers in which the coupling dyes have suitable dispersibility.

Typical examples of polymerized dye-forming couplers which can be used are disclosed in, e.g., U.S. Pat. Nos. 3,451,820, 4,080,211, 4,367,282, 4,409,320 and 4,576,910 and U.K. Patent 2,102,173.

Couplers that may be suitably employed in the invention also include couplers which release photographically useful residues during the process of coupling. The compounds disclosed in the patents cited in the above-noted RD17643, Item VII-F, JP-A-57-151944, JP-A-57-154234, JP-A-60-184248, JP-A-63-37346 and U.S. Pat. Nos. 4,248,962 and 4,782,012 are suitable as DIR couplers which release development inhibition agents.

The materials disclosed in U.K. Patents 2,097,140 and 2,131,188, JP-A-59-157638 and JP-A-59-170840 are preferable as couplers which release development accelerators or nucleating agents in correspondence to the image formed at the time of development.

Other couplers that may be employed in the photographic material of the invention include competitive couplers as disclosed in, e.g., U.S. Pat. No. 4,130,427, multi-equivalent couplers as disclosed in, e.g., U.S. Pat. Nos. 4,283,472, 4,338,393 and 4,310,618, DIR redox compound releasing couplers, DIR coupler releasing couplers, DIR coupler releasing redox compounds or DIR redox releasing redox compounds as disclosed in, e.g., JP-A-60-185950 and JP-A-62-24252, the couplers disclosed in European Patent 173302A which release dyes that recolor after elimination, bleaching accelerator releasing couplers as disclosed in, e.g., RD Nos. 11449 and 24241 and JP-A-61-201247, ligand releasing couplers as disclosed in e.g., U.S. Pat. No. 4,553,477, the couplers disclosed in JP-A-63-75747 which release leuco dyes and the couplers disclosed in U.S. Pat. No. 4,774,181 which release fluorescent dyes.

The couplers employed in the invention can be incorporated into the photographic material using a variety of known dispersion methods.

Examples of high boiling point solvents that are employable in an oil-in-water dispersion process are disclosed in, e.g., U.S. Pat. No. 2,322,027, and specific examples of high boiling point organic solvents that have a boiling point of 175° C. or more at normal pressure and are employable in an oil-in-water process include phthalic acid esters (dibutylphthalate, dicyclohexylphthalate, di-2-ethylhexylphthalate, decylphthalate, bis(2,4-di-t-amylphenyl)phthalate, bis(2,4-di-t-amylphenyl)isophthalate, bis(1,1-diethylpropyl)phthalate, etc.), phosphoric or phosphonic acid esters(triphenylphosphate, tricresylphosphate, 2-ethylphexyldiphenylphosphate, tricyclohexylphosphate, tri-2-ethylhexylphosphate, tridecylphosphate, tributoxyethylphosphate, trichloropropylphosphate, di-2-ethylhexylphenylphosphonate, etc.), benzoic acid esters (2-ethylhexylbenzoate, dodecylbenzoate, 2-ethylhexyl-p-hydroxybenzoate, etc.), amides (N,N-diethyldodecaneamide, N,N-diethyllaurylamide, N-tetradecylpyrrolidone, etc.), alcohols and phenols (isostearyl alcohol, 2,4-di-tertqmylphenol, etc.), aliphatic carboxylic acid esters (bis(2-ethylhexyl)sebacate, dioctylazelate, glycerol tributyrate, isostearyl lactate, trioctyl citrate, etc.) aniline derivatives, (N,N-dibutyl-2-butoxy-5-tert-octylaniline, etc.) and hydrocarbons (paraffin, dodecylbenzene, di-isopropylnaphthalene, etc.). Solvents such as organic solvents with a boiling point of about 30° C. or more and preferably 50° to 160° C. can be used as auxiliary solvents. Typical examples include ethyl acetate, butyl acetate, ethyl proprionate, methyl ethyl ketone, cyclohexanone, 2-ethoxyethyl acetate and dimethylformamide.

Specific examples of latex dispersion processes and effects and of latexes which can be impregnated are given in, e.g., U.S. Pat. No. 4,199,363 and West German Patent Applications (OLS) 2,541,274 and 2,541,230.

The couplers can be impregnated in loadable latex polymers (as in, e.g., U.S. Pat. No. 4,203,716) in the presence of or in the absence of a high boiling point organic solvent as described above or can be dissolved in a polymer that is insoluble in water and soluble in organic solvents and emulsified and dispersed in a hydrophilic colloidal aqueous solution.

Preferably, the homopolymers or copolymers disclosed on pages 12 to 30 of the specification of published International Application WO88/00723 are used. From the point of view of color image stability, etc. use of acrylamide polymers is particularly preferred.

The present invention can be employed for a variety of color photographic materials. The present invention is particularly suitable for use for color negative films for general-purpose use or for motion pictures and color reversal film for slides or television.

Suitable supports that can be employed in the invention are described in, e.g., RD No. 17643, page 28 and No. 18716, page 647 right-hand column to page 648 left-hand column.

A more detailed description of the invention is given below with reference to examples thereof, although the invention is not to be construed as being limited to these examples. Unless otherwise indicated, all parts, percents ratios and the like are by weight.

EXAMPLE 1

A sample was prepared in the form of a multi-layer color photographic material comprising layers with the compositions noted below on a subbed cellulose triacetate film support.

PHOTOGRAPHIC LAYER COMPOSITIONS

The coating quantities are expressed in terms of $g/m^2$ of silver in the case of silver halides and colloidal silver, as amounts in $g/m^2$ in the case of couplers, additives and gelatin and as the number of moles per mole of silver halide in a given layer in the case of sensitization dyes.

| | |
|---|---|
| First Layer (antihalation layer) | |
| Black Colloidal Silver | 0.15 |
| Gelatin | 1.5 |
| ExM-8 | 0.08 |
| UV-1 | 0.03 |
| UV-2 | 0.06 |

-continued

| | |
|---|---|
| Solv-2 | 0.08 |
| UV-3 | 0.07 |
| Cpd-5 | $6 \times 10^{-4}$ |
| Second Layer (intermediate layer) | |
| Gelatin | 1.5 |
| UV-1 | 0.03 |
| UV-2 | 0.06 |
| UV-3 | 0.07 |
| ExF-1 | 0.004 |
| Solv-2 | 0.07 |
| Cpd-5 | $6 \times 10^{-4}$ |
| Third Layer (first red-sensitive emulsion layer) | |
| Silver iodobromide emulsion (AgI 2 mol %, high internal AgI type, equivalent sphere diameter 0.3 μm) Coated silver quantity | 0.5 |
| Gelatin | 0.8 |
| ExS-1 | $1.0 \times 10^{-4}$ |
| ExS-2 | $3.0 \times 10^{-4}$ |
| ExS-3 | $1 \times 10^{-5}$ |
| ExC-3 | 0.22 |
| ExC-4 | 0.02 |
| Cpd-5 | $3 \times 10^{-4}$ |
| Fourth Layer (second red-sensitive emulsion layer) | |
| Silver iodobromide emulsion (AgI 4 mol %, high internal AgI type, equivalent sphere diameter 0.55 μm) Coated silver quantity | 0.7 |
| Gelatin | 1.26 |
| ExS-1 | $1 \times 10$ |
| ExS-2 | $3 \times 10$ |
| ExS-3 | $1 \times 10$ |
| ExC-3 | 0.33 |
| ExC-4 | 0.01 |
| ExY-16 | 0.01 |
| ExC-7 | 0.04 |
| ExC-2 | 0.08 |
| Solv-1 | 0.03 |
| Cpd-5 | $5 \times 10^{-4}$ |
| Fifth Layer (third red-sensitive emulsion layer) | |
| Silver iodobromide emulsion (AgI 10 mol %, high internal AgI type, equivalent sphere diameter 0.7 μm) Coated silver quantity | 0.7 |
| Gelatin | 0.8 |
| ExS-1 | $1 \times 10^{-4}$ |
| ExS-2 | $3 \times 10^{-4}$ |
| ExS-3 | $1 \times 10^{-5}$ |
| ExC-5 | 0.05 |
| ExC-6 | 0.06 |
| Solv-1 | 0.15 |
| Solv-2 | 0.08 |
| Cpd-5 | $3 \times 10^{-5}$ |
| Sixth Layer (intermediate layer) | |
| Gelatin | 0.6 |
| Cpd-5 | $4 \times 10^{-4}$ |
| Cpd-1 | 0.10 |
| Cpd-4 | 1.23 |
| Solv-1 | 0.05 |
| Cpd-3 | 0.25 |
| Seventh Layer (first green-sensitive emulsion layer) | |
| Silver iodobromide emulsion (AgI 3 mol %, high internal AgI type, equivalent sphere diameter 0.3 μm) Coated silver quantity | 0.30 |
| Gelatin | 0.4 |
| ExS-4 | $5 \times 10^{-4}$ |
| ExS-6 | $0.3 \times 10^{-4}$ |
| ExS-5 | $2 \times 10^{-4}$ |
| ExM-9 | 0.2 |
| ExY-14 | 0.03 |
| ExM-8 | 0.03 |
| Solv-1 | 0.2 |
| Cpd-5 | $2 \times 10^{-4}$ |
| Eighth Layer (second green-sensitive emulsion layer) | |
| Silver iodobromide emulsion (AgI 4 mol %, high internal AgI type, equivalent sphere diameter 0.55 μm) Coated silver quantity | 0.6 |
| Gelatin | 0.8 |

-continued

| | |
|---|---|
| ExS-4 | $5 \times 10^{-4}$ |
| ExS-5 | $2 \times 10^{-4}$ |
| ExS-6 | $0.3 \times 10^{-4}$ |
| ExM-9 | 0.25 |
| ExM-8 | 0.03 |
| ExM-10 | 0.015 |
| ExY-14 | 0.04 |
| Solv-1 | 0.2 |
| Cpd-5 | $3 \times 10^{-4}$ |
| Nineth Layer (third green-sensitive emulsion layer) | |
| Silver iodobromide emulsion (AgI 10 mol %, high internal AgI type, equivalent sphere diameter 0.7 μm) Coated silver quantity | 0.85 |
| Gelatin | 1.0 |
| ExS-4 | $2.0 \times 10^{-4}$ |
| ExS-5 | $2.0 \times 10^{-4}$ |
| ExS-6 | $0.2 \times 10^{-4}$ |
| ExS-7 | $3.0 \times 10^{-4}$ |
| ExM-12 | 0.06 |
| ExM-13 | 0.02 |
| ExM-8 | 0.02 |
| Solv-1 | 0.20 |
| Solv-2 | 0.05 |
| Cpd-5 | $4 \times 10^{-4}$ |
| Tenth Layer (Yellow filter layer) | |
| Gelatin | 0.9 |
| Yellow Colloidal Silver | 0.05 |
| Cpd-1 | 0.2 |
| Solv-1 | 0.15 |
| Cpd-5 | $4 \times 10^{-4}$ |
| Eleventh Layer (first blue-sensitive emulsion layer) | |
| Silver iodobromide emulsion (AgI 4 mol %, high internal AgI type, equivalent sphere diameter 0.5 μm) Coated silver quantity | 0.4 |
| Gelatin | 1.0 |
| ExS-8 | $2 \times 10^{-4}$ |

-continued

| | |
|---|---|
| ExY-16 | 0.9 |
| ExY-14 | 0.09 |
| Solv-1 | 0.3 |
| Cpd-5 | $4 \times 10^{-4}$ |
| Twelfth Layer (second blue-sensitive emulsion layer) | |
| Silver iodobromide emulsion (AgI 10 mol %, high internal AgI type, equivalent sphere diameter 1.3 μm) Coated silver quantity | 0.5 |
| Gelatin | 0.6 |
| ExS-8 | $1 \times 10^{-4}$ |
| ExY-16 | 0.12 |
| Solv-1 | 0.04 |
| Cpd-5 | $2 \times 10^{-4}$ |
| Thirteenth Layer (first protective layer) | |
| Micrograin silver iodobromide (average grain diameter 0.07 μm, AgI 1 mol %) | 0.2 |
| Gelatin | 0.9 |
| UV-3 | 0.1 |
| UV-4 | 0.1 |
| UV-5 | 0.2 |
| Solv-3 | 0.04 |
| Cpd-5 | $3 \times 10^{-4}$ |
| Fourteenth Layer (second protective layer) | |
| Gelatin | 0.9 |
| Polymethylmethacrylate Grains (diameter 1.5 μm) | 0.2 |
| Cpd-5 | $4 \times 10^{-4}$ |
| H-1 | 0.4 |

In addition to the components noted above, a surfactant as a coating assistant was added to each layer.

The chemical structural formulas or the chemical names of the compounds that were used in the above are set forth below.

UV-1

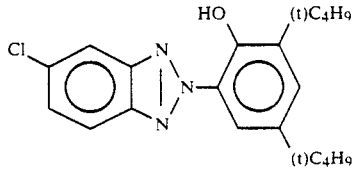

UV-2

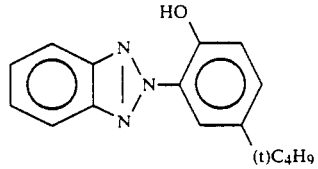

UV-3

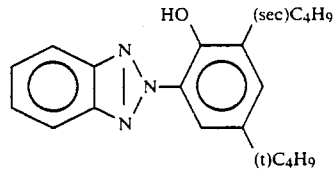

UV-4

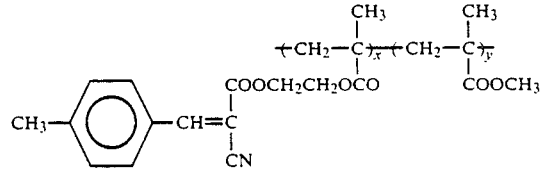

x/y = 7/3 (weight ratio)
MW = about 3,000

-continued
UV-5
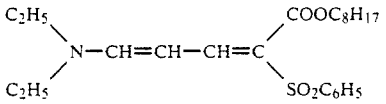
Solv-1:
Tricresyl phosphate
Solv-2:
Dibutyl phthalate
Solv-3:
bis(2-Ethylhexyl)phthalate
ExM-8:
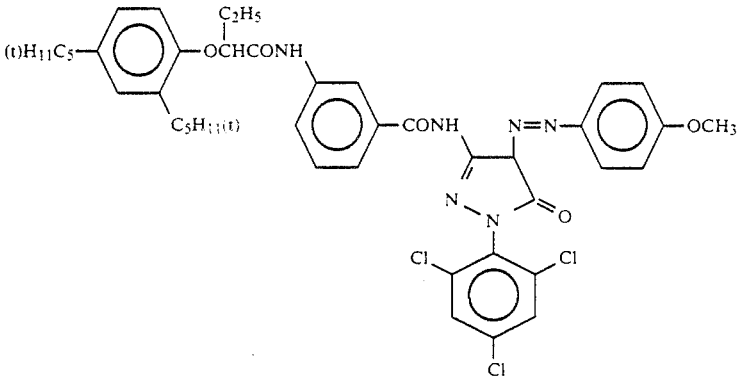
ExF-1:
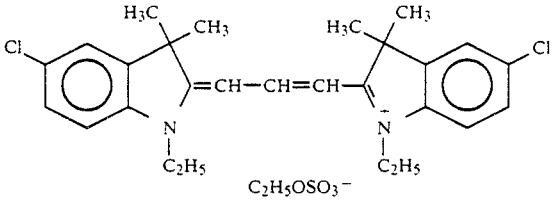
ExC-2:
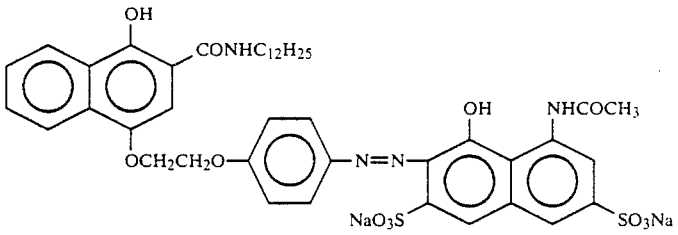
ExC-3
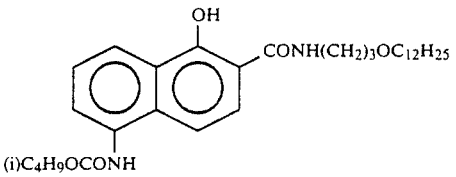
ExY-14:

-continued
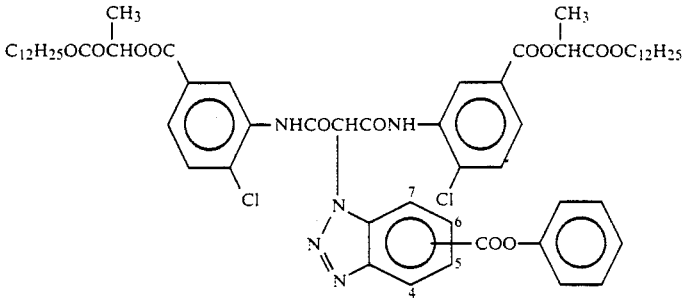
(A mixture of four compounds substituted at 4-, 5-, 6- or 7)
ExC-4
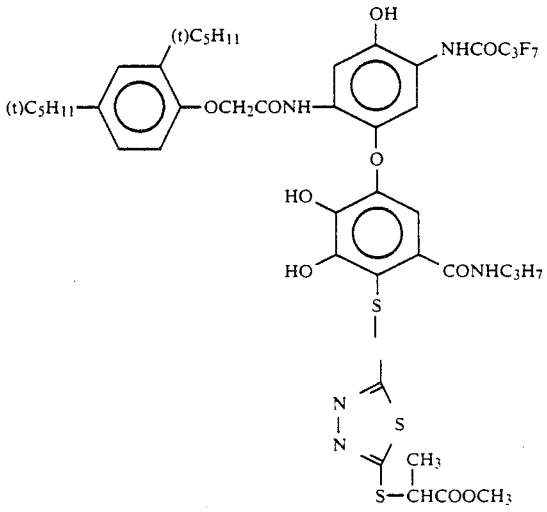
ExC-5:
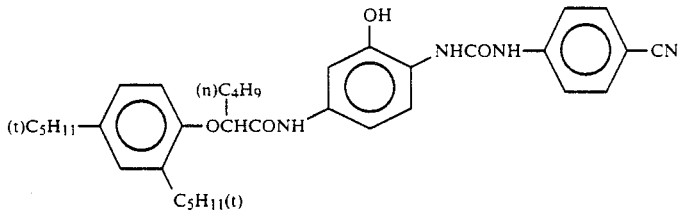
ExC-6:
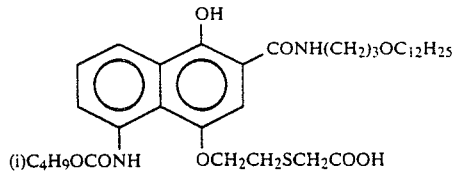
ExC-7
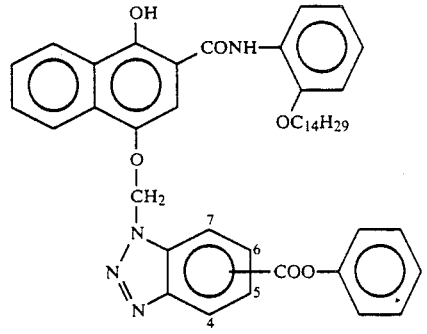

-continued
(A mixture of four compounds substituted at 4-, 5-, 6- or 7)
ExM-9:
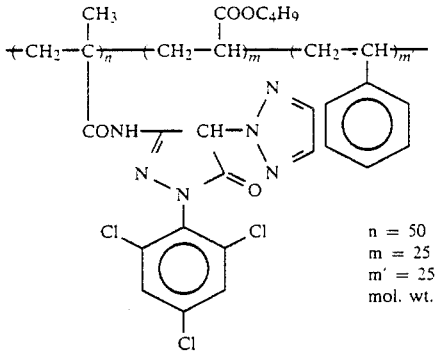
n = 50
m = 25
m' = 25
mol. wt. about 20,000
ExM-10:
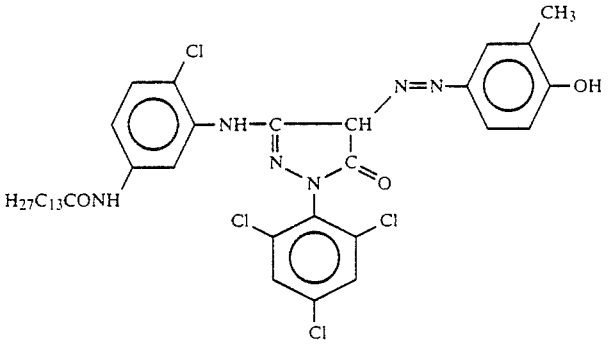
ExM-12:
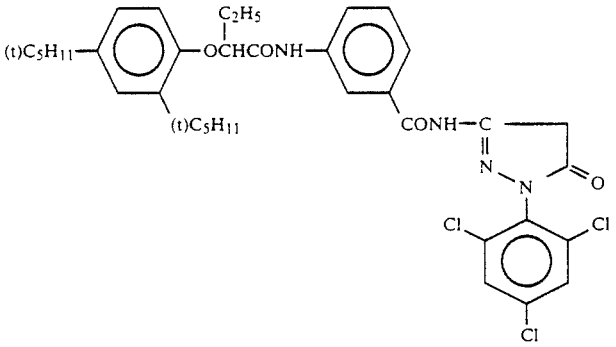
ExM-13:
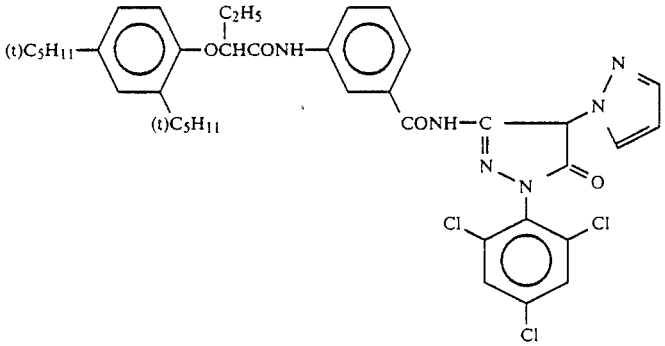
ExY-16:

-continued
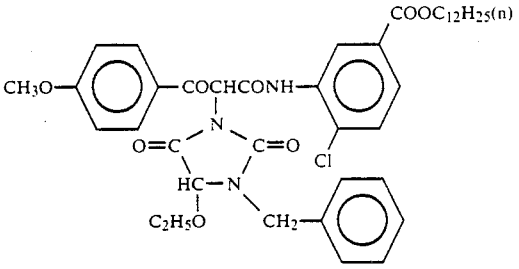
Cpd-1:
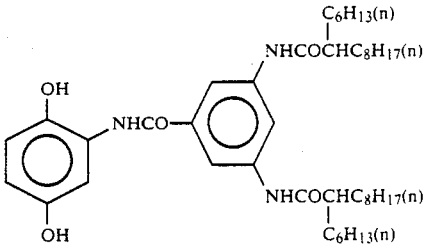
Cpd-3:
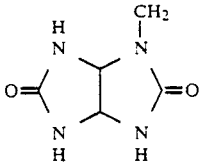
Cpd-4:
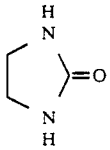
Cpd-5:
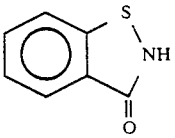
ExS-1:
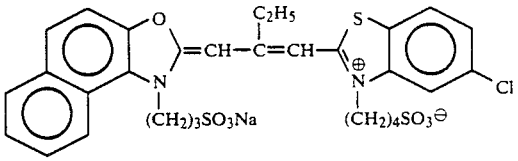
ExS-2:
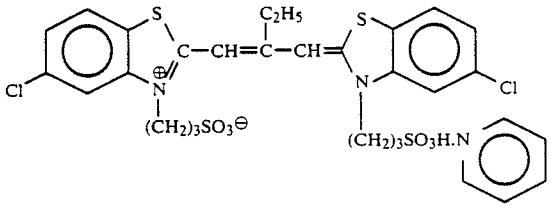
ExS-3:

-continued

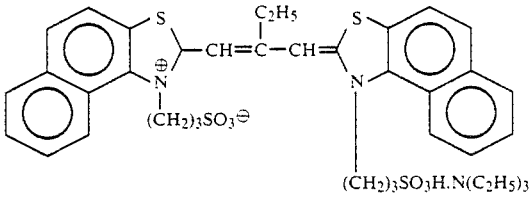

ExS-4:

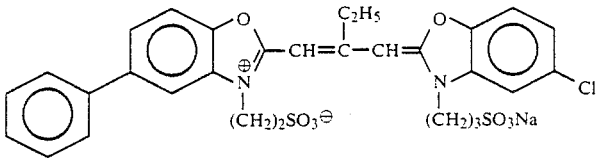

ExS-5:

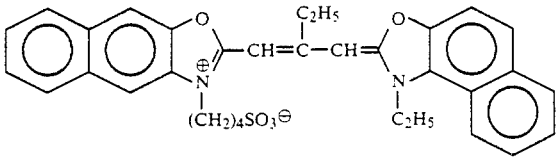

ExS-6:

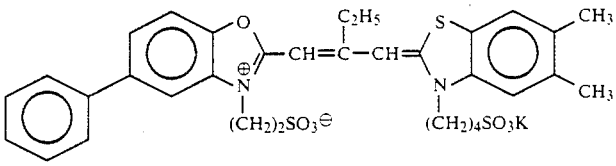

ExS-7:

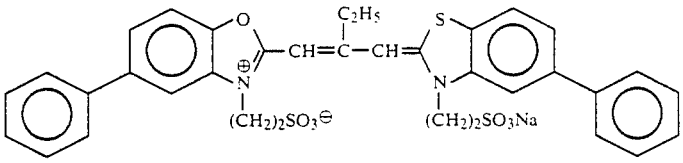

ExS-8:

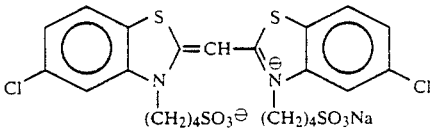

H-1:

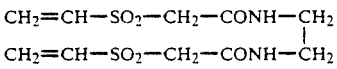

Samples 1-A to E were prepared by varying the average aspect ratio of 95 to 100% (occupying ratio of the projected area of the grains selected as described hereinbefore) of the total of the silver halide grains in the emulsion compositions of the various layers in the manner indicated in Table 1 below. In all of the samples, the hydrophilic colloid layer thickness was 18 μm.

TABLE 1

| Sample (layer) | 1-A | 1-B | 1-C | 1-D | 1-E |
|---|---|---|---|---|---|
| 3rd layer | 2.5 | 5.5 | 8.0 | 3.0 | 4.5 |
| 4th | 1.5 | 5.5 | 8.0 | 3.0 | 4.5 |
| 5th | 2.5 | 5.5 | 8.0 | 3.0 | 4.5 |
| 7th | 2.0 | 5.0 | 9.5 | 4.0 | 3.5 |

TABLE 1-continued

| Sample (layer) | 1-A | 1-B | 1-C | 1-D | 1-E |
|---|---|---|---|---|---|
| 8th | 2.0 | 5.0 | 9.5 | 4.0 | 3.5 |
| 9th | 2.5 | 5.0 | 9.5 | 4.0 | 3.5 |
| 11th | 1.5 | 5.5 | 10.0 | 5.5 | 4.0 |
| 12th | 3.0 | 5.5 | 10.0 | 5.5 | 4.0 |

Each of the samples thus produced was slit to 35 mm wide and image wise exposed.

Next, an ion exchange membrane electrodialysis and halogen ion concentration adjustment unit was installed in the manner described in the examples of the disclosure of JP-A-54-37731 (corresponding to U.S. Pat. No.

Figure 4:
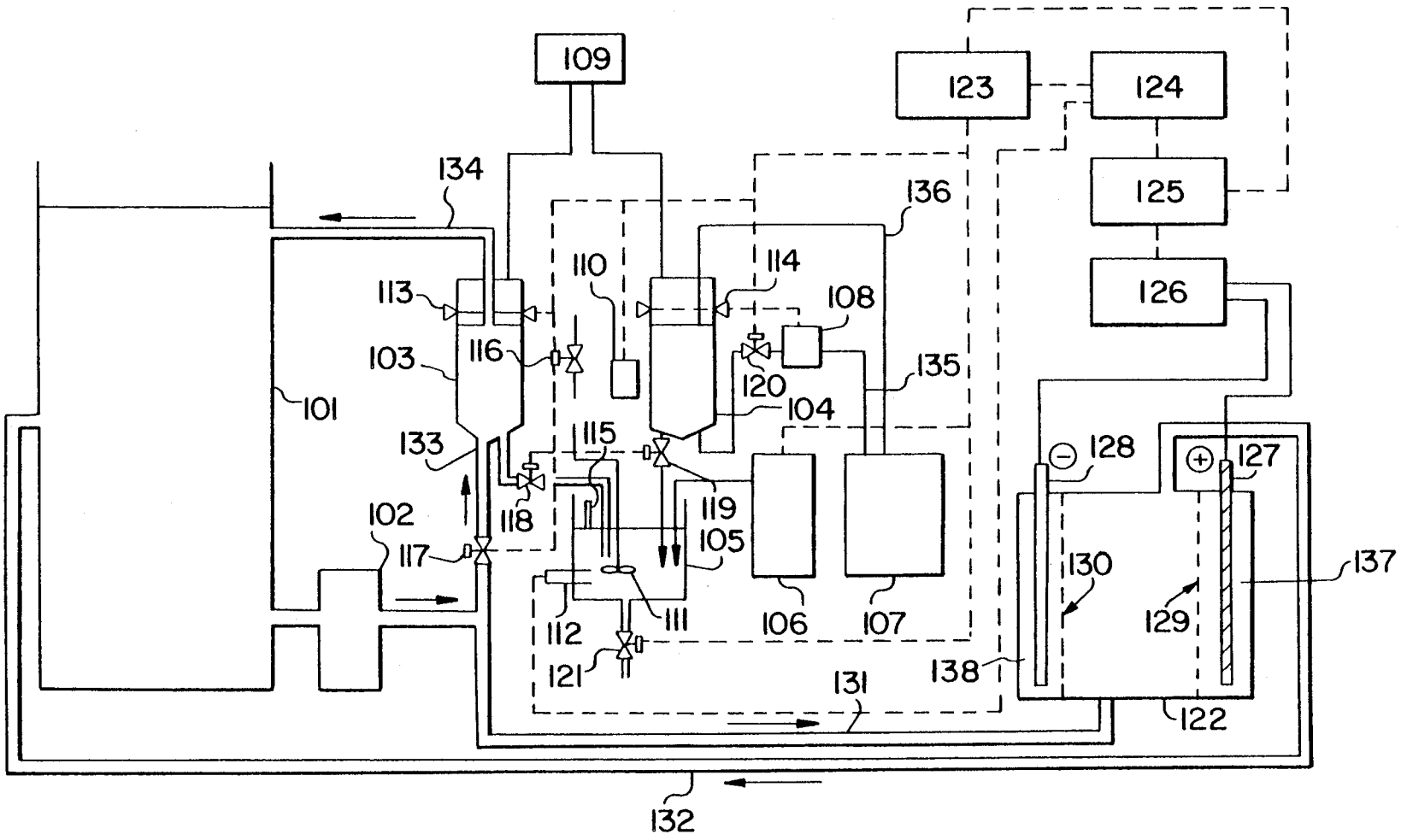
FIG. 4 is a schematic diagram of an apparatus for controlling the halogen ion concentration of a developer.

4,207,157), the disclosure of which is incorporated herein by reference, following the arrangement shown in FIG. 4 of that disclosure.

FIG. 4 shows an apparatus for controlling the halogen ion concentration of a developer composed of an automatic silver ion titration means, an automatic halogen ion determination means, and a halogen ion concentration controlling means. The automatic silver ion titration means is composed of means for measuring a sample developer and reagents, and a titration cell. The automatic halogen ion determination means is composed of a halogen ion-sensitive electrode system for detecting the halogen ion concentration of the solution in the titration cell, and operating means for indicating the amount of halogen ions by detecting the change of the potential of the electrode. The halogen ion concentration controlling means is composed of a halogen ion removing means controlled by the signal from the automatic halogen ion determination means.

Each of the above means will now be explained in detail. In FIG. 4 a processing solution or a developer placed in a tank 101 is introduced into a halogen ion removing means 122 through a pipe 131 by a liquid pump 102. Part of the processing solution is sent from the pipe 131 to a sample measuring vessel 103 through an electromagnetic valve 117 and a sampling pipe 133. A reagent (e.g., an aqueous sulfuric acid solution) stored in a reagent solution tank 107 is, when an electromagnetic valve 120 opens, supplied to a reagent measuring vessel 104 through a pipe 135 by a pump 108. After the sample and the reagent solution are introduced in the vessels 103 and 104 to the levels determined by electroluminescent diodes 113 and 114 respectively, the excessive sample and reagent solution are sent back to the processing solution tank 101 and the reagent solution tank 107 through return pipes 134 and 136 by the action of a compressor 109, which makes for an accurate measurement of the sample and the reagent.

Water is stored in a measuring cell 105 before titration, and at titration the water is completely discharged through an electromagnetic valve 121. Thereafter, an electromagnetic valve 118 or 119 opens to add thereto the sample or the reagent solution, either separately or simultaneously. The solution is mixed by a stirrer 111 driven by a motor 110. After waiting several minutes to stabilizing the indication potential, a silver nitrate titration reagent solution is added to the measuring cell 105 from an automatic supply tank 106.

The halogen ion concentration in the solution to be titrated is continuously detected by a halogen ion sensitive electrode 112 composed of a silver/silver halide electrode or a silver electrode and a mercurous sulfate reference electrode, and the titration is continued until a unit 124 detects the end point. After the titration is finished the valve 121 opens, the solution containing precipitates in the cell is discarded, and thereafter an electromagnetic valve 116 opens and fresh washing water is introduced into the cell. The amount of washing water is determined by the level sensed by a platinum liquid level detecting electrode 115. The washing water thus introduced into the cell is stirred for a predetermined period of time by motor 110 and is then discharged from the cell. This operation is repeated several times, and then returns to the initial step.

A series of these operations are performed by a timing unit 123 and a control unit 125 if the titration time is determined by the aforesaid manner, a definite current corresponding to the titration time is applied between an anode 127 and a cathode 128 of a halogen ion removing means 122 from a current control unit 126. Thus, the halogen ions in the processing solution introduced into the removing means 122 transfer through an anion exchange membrane 129 into an anodic chamber 137, while cations transfer through a cation exchange membrane 130 into a cathodic chamber 138. The processing solution with its reduced halide ion concentration is sent back to the processing solution tank 101 through a return line 132. A series of these operations are performed by sequential instructions from the timing unit 123.

Figure 5:
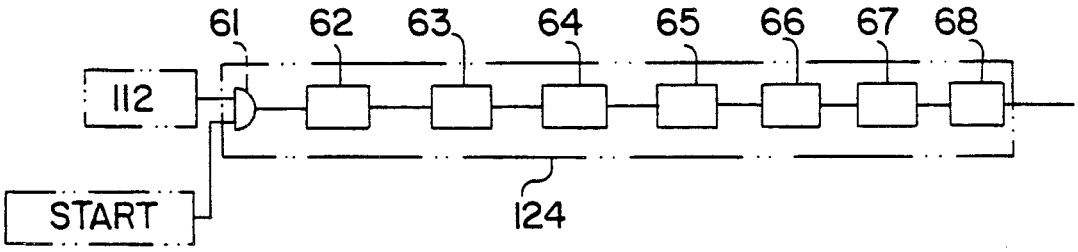
FIG. 5 is a block diagram showing the halogen ion determining means in the present invention.

The end point of the titration is detected by the unit 124, which senses the change in the halogen ion concentration of the reaction liquid in the measurement cell 105 as a change in potential, introduces it to a differential circuit through a noise filter, and outputs the change of the potential ratio to detect the end point of the titration. A block diagram thereof is shown in FIG. 5. The signal from the halogen ion detection electrode 112 is fed to an amplifier 62 through a gate circuit 61, amplified therein to a predetermined level, fed through a low pass filter 63 to remove the noise differentiated by a primary differential circuit 64, amplified by an amplifier 65, fed through a second low pass filter 66 to remove any new noise, and differentiated by a secondary differential circuit 67. The zero cross point is then detected by a comparator 68, whose output indicated the end point of the titration.

This unit was connected to the development solution tank of an automatic development unit in the manner shown in FIG. 3, development solution overflow solution was stocked and regeneration agents were added, thus preparing a system for re-use of the overflow solution as replenishment solution. The details of the various stages were as follows.

| Stage | Time | Temperature | Replenishment Quantity (per 3.5l × 1 ml) | Tank Capacity |
|---|---|---|---|---|
| Color Development | 3' 15" | 37.8° C. | 7.5 ml | 100 l |
| Bleaching | 3' 00" | 37.8° C. | 5 ml | 100 l |
| Fixing | 4' 00" | 37.8° C. | 30 ml | 100 l |
| Stabilization (1) | 45" | 35° C. | — | 20 l |
| Stabilizatien (2) | 45" | 35° C. | — | 20 l |
| Stabilization (3) | 45" | 35° C. | 20 ml | 20 l |
| Drying | 60" | 40~60° C. | — | — |

A multistage counterflow system going from (3) to (2) to (1) was employed for the stabilization solution.

The processing solution compositions used were as follows.

| | Mother liquor (g) | Replenishment solution (g) |
|---|---|---|
| Color Development Solution | | |
| 1-Hydroxyethylidene-1,1-diphosphonic Acid (60% aqueous solution) | 1.5 | 1.5 |
| Diethylenetriaminepenta-acetic Acid | 5.0 | 5.0 |
| Sodium Sulfite | 4.0 | 6.0 |
| Potassium Carbonate | 30.0 | 37.0 |
| Potassium Bromide | As noted in Table 1 | — |
| Hydroxylamine Sulfate | 2.0 | 4.0 |
| 4-(N-Ethyl-N-β-hydroxyethyl amino)-2-methylaniline | 4.7 | 8.0 |

-continued

| | Mother liquor (g) | Replenishment solution (g) |
|---|---|---|
| Sulfate | | |
| Water added | 1.0 l | 1.0 l |
| pH | 10.0 | 10.25 |
| Bleaching Solution | | |
| Ferric Ammonium ethylenediaminetetra-acetate-dihydrate | 70.0 | 120.0 |
| Ferric 1,3-Diaminopropane-tetraacetate | 35.0 | 55.0 |
| Ethylenediametetraacetic acid | 4.0 | 5.0 |
| Ammonium Bromide | 100.0 | 160.0 |
| Ammonium Nitrate | 30.0 | 50.0 g |
| Aqueous Ammonia (27% aqueous solution) | 20.0 ml | 23.0 ml |
| Acetic Acid (98%) | 9.0 ml | 15.0 ml |
| Water added | 1.0 l | 1.0 l |
| pH | 5.5 | 4.5 |
| Fixing Solution | | |
| Disodium Ethylenediamine-tetraacetate | 0.5 | 0.7 |
| Sodium Sulfite | 7.0 | 8.0 |
| Sodium Bisulfite | 5.0 | 5.5 |
| Ammonium Thiosulfate (70% aqueous solution) | 170.0 ml | 200.0 ml |
| Water added | 1.0 l | 1.0 l |
| pH | 6.7 | 6.6 |

| Stabilization Solution: | (Same for both mother liquor and replenishment solution) |
|---|---|
| 5-Chloro-2-methyl-4-isothiazoline-3-one | 6.0 mg |
| 2-Methyl-4-isothiazoline-3-one | 3.0 mg |
| Surfactant $[C_{10}H_{21}—O—(—CH_2CH_2O)_{10}—H]$ | 0.4 |
| Water added | 1.0 l |
| pH | 5.0 to 7.0 |

In the ion exchange membrane electrodialysis bath, the desalting chambers (5 $dm^2 \times 20$ chambers) were connected and development solution was circulated. This development solution was diluted to $\frac{1}{4}$ its original concentration in the concentration chambers, 4.5 g of potassium bromide per l was added and 10 of the resulting solution was circulated (10 l/min). Platinum-plated titanium was used as the anode in the anode chamber and stainless steel as the cathode in the cathode chamber. Twenty l of the following electrode solution was circulated.

| Electrode Solution: | |
|---|---|
| Sodium Carbonate | 30 g |
| Sodium Bicarbonate | 6 g |
| EDTA.2Na | 1 g |
| Water added | 1 l |
| pH | 10.20 |

When 75 l of the color development solution overflow solution had been stocked, the following chemicals were added, the amount of solution was adjusted to 100 l and the solution was re-used as replenishment solution.

| | |
|---|---|
| Overflow Solution | 75 l |
| 1-Hydroxyethylidene-1,1-diphosphonic Acid | 38 g |
| Diethylenetriaminepentaacetic Acid | 75 g |
| Sodium Sulfite | 300 g |
| Potassium Carbonate | 1450 g |
| Hydroxylamine Sulfate | 250 g |

-continued

| | |
|---|---|
| 4-[N-Ethyl-N-β-hydroxyethylamino]-2-methylaniline Sulfate | 450 g |
| Water added to make | 100 l |
| pH | 10.25 |

Next, the Br ion concentrations of the tank solution constituting the running start solution and in the halogen ion concentration adjustment unit were varied in the manner shown in Table 2 below. In each case of the running operation at starting and after regeneration and re-use of 100 l of the regenerated refleshment were effected up to 20 times changes in photographic characteristics that occurred were investigated.

Samples 1-A to 1-E were subjected to wedge exposure, and the changes in the photographic characteristics were determined at the time of the start of operation and after the 5th, the 10th, the 15th and the 20th regeneration and re-use. Changes in the yellow photographic characteristic relative to the initial yellow photographic characteristic (change in minimum yellow density) were determined.

TABLE 2

| Sample | Bromine Ion Concentration (mol/l) | Remarks | Initial | 5th | 10th | 15th | 20th |
|---|---|---|---|---|---|---|---|
| 1-A | $5 \times 10^{-3}$ | Comparison example | 0 | −0.05 | −0.09 | −0.11 | −0.13 |
| | $7 \times 10^{-3}$ | Comparison example | 0 | −0.03 | −0.05 | −0.06 | −0.07 |
| | $11 \times 10^{-3}$ | Comparison example | 0 | −0.02 | −0.04 | −0.05 | −0.06 |
| | $14 \times 10^{-3}$ | Comparison example | 0 | −0.04 | −0.08 | −0.09 | −0.10 |
| 1-B | $5 \times 10^{-3}$ | Comparison example | 0 | −0.04 | −0.08 | −0.10 | −0.10 |
| | $7 \times 10^{-3}$ | The invention | 0 | −0.01 | −0.02 | −0.03 | −0.03 |
| | $11 \times 10^{-3}$ | The invention | 0 | −0.01 | −0.02 | −0.03 | −0.03 |
| | $14 \times 10^{-3}$ | Comparison example | 0 | −0.03 | −0.07 | −0.08 | −0.09 |
| 1-C | $5 \times 10^{-3}$ | Comparison example | 0 | −0.04 | −0.06 | −0.7 | −0.7 |
| | $7 \times 10^{-3}$ | The invention | 0 | −0.01 | −0.01 | −0.01 | −0.01 |
| | $11 \times 10^{-3}$ | The invention | 0 | 0 | 0 | 0 | 0 |
| | $14 \times 10^{-3}$ | Comparison example | 0 | −0.04 | −0.05 | 0.06 | −0.07 |
| 1-D | $5 \times 10^{-3}$ | Comparison example | 0 | −0.04 | −0.06 | −0.07 | −0.08 |
| | $7 \times 10^{-3}$ | The | 0 | −0.01 | −0.02 | −0.03 | −0.03 |

TABLE 2-continued

| Sample | Bromine Ion Concentration (mol/l) | Remarks | Initial | 5th | 10th | 15th | 20th |
|---|---|---|---|---|---|---|---|
| | | invention | | | | | |
| | $11 \times 10^{-3}$ | The invention | 0 | −0.01 | −0.02 | −0.03 | −0.03 |
| | $14 \times 10^{-3}$ | Comparison example | 0 | −0.03 | −0.07 | −0.08 | −0.08 |
| I-E | $5 \times 10^{-3}$ | Comparison example | 0 | −0.04 | −0.06 | −0.07 | −0.08 |
| | $7 \times 10^{-3}$ | Comparison example | 0 | −0.02 | −0.05 | −0.06 | −0.06 |
| | $11 \times 10^{-3}$ | Comparison example | 0 | −0.02 | −0.04 | −0.05 | −0.06 |
| | $14 \times 10^{-3}$ | Comparison example | 0 | −0.03 | −0.07 | −0.08 | −0.08 |

In the invention, good photographic characteristics were displayed, use changes in the minimum density in the regeneration running tests being kept to within a laboratory control range (±0.03), and particularly good results were displayed by Sample I-C which contained emulsion layers with an average aspect ratio of 8.0 or more.

EXAMPLE 2

Multilayer color photosensitive materials were produced by coating successive layers with the compositions noted below on a subbed cellulose triacetate film support.

PHOTOGRAPHIC LAYER COMPOSITIONS

The figures for the various components are coating amounts expressed as g/m$^2$. In the case of silver halide, coating amounts are expressed in terms of silver, and in the case of the sensitization dyes, coating amounts relative to 1 mole of silver halide in a given layer are indicated in mole units.

| | | |
|---|---|---|
| First Layer: (antihalation layer) | | |
| Black Colloidal Silver | Silver | 0.18 |
| Gelatin | | 0.40 |
| Second Layer: (intermediate layer) | | |
| 2,5-Di-t-pentadecylhydroquinone | | 0.18 |
| EX-1 | | 0.07 |
| EX-3 | | 0.02 |
| EX-12 | | 0.002 |
| U-1 | | 0.06 |
| U-2 | | 0.08 |
| U-3 | | 0.10 |
| HBS-1 | | 0.10 |
| HBS-2 | | 0.02 |
| Gelatin | | 1.04 |
| Third Layer (first red-sensitive emulsion layer) | | |
| Silver iodobromide emulsion (Silver iodide 6 mol %, average grain diameter 0.6 μm obtained by converting the projected area to a circle: the same hereinafter) | Silver | 0.55 |
| Sensitization Dye I | | $6.9 \times 10^{-5}$ |
| Sensitization Dye II | | $1.8 \times 10^{-5}$ |
| Sensitization Dye III | | $3.1 \times 10^{-4}$ |
| Sensitization Dye IV | | $4.0 \times 10^{-5}$ |
| EX-2 | | 0.350 |
| HBS-1 | | 0.005 |
| EX-10 | | 0.020 |
| Gelatin | | 1.20 |
| Fourth Layer (second red-sensitive emulsion layer) | | |
| Tabular silver iodobromide emulsion (Silver iodide 10 mol %, average grain diameter 0.7 μm) | Silver | 1.0 |
| Sensitization Dye I | | $5.1 \times 10^{-5}$ |
| Sensitization Dye II | | $1.4 \times 10^{-5}$ |
| Sensitization Dye III | | $2.3 \times 10^{-4}$ |
| Sensitization Dye IV | | $3.0 \times 10^{-5}$ |
| EX-2 | | 0.400 |
| EX-3 | | 0.050 |
| EX-10 | | 0.015 |
| Gelatin | | 1.30 |
| Fifth Layer (third red-sensitive emulsion layer) | | |
| Silver iodobromide emulsion (Silver iodide 16 mol %, average grain diameter 1.1 μm) | Silver | 1.60 |
| Sensitization Dye IX | | $5.4 \times 10^{-5}$ |
| Sensitization Dye II | | $1.4 \times 10^{-5}$ |
| Sensitization Dye III | | $2.4 \times 10^{-4}$ |
| Sensitization Dye IV | | $3.1 \times 10^{-5}$ |
| EX-3 | | 0.240 |
| EX-4 | | 0.120 |
| HBS-1 | | 0.22 |
| HBS-2 | | 0.10 |
| Gelatin | | 1.63 |
| Sixth Layer (intermediate layer) | | |
| EX-5 | | 0.40 |
| HBS-1 | | 0.020 |
| EX-12 | | 0.004 |
| Gelatin | | 0.80 |
| Seventh Layer (first green-sensitive emulsion layer) | | |
| Silver iodobromide emulsion (Silver iodide 6 mol %, average grain diameter 0.6 μm) | Silver | 0.40 |
| Sensitization Dye V | | $3.0 \times 10^{-5}$ |
| Sensitization Dye VI | | $1.0 \times 10^{-4}$ |
| Sensitization Dye VII | | $3.8 \times 10^{-4}$ |
| EX-6 | | 0.260 |
| EX-1 | | 0.021 |
| EX-7 | | 0.030 |
| EX-8 | | 0.025 |
| HBS-1 | | 0.100 |
| HBS-2 | | 0.010 |
| Gelatin | | 0.75 |
| Eighth Layer (second green-sensitive emulsion layer) | | |
| Silver iodobromide emulsion (Silver iodide 9 mol %, average grain diameter 0.7 μm) | Silver | 0.80 |
| Sensitization Dye V | | $2.1 \times 10^{-5}$ |
| Sensitization Dye VI | | $7.0 \times 10^{-5}$ |
| Sensitization Dye VII | | $2.6 \times 10^{-4}$ |
| EX-6 | | 0.180 |
| EX-8 | | 0.010 |
| EX-1 | | 0.008 |
| EX-7 | | 0.012 |
| HBS-1 | | 0.160 |
| HBS-4 | | 0.008 |
| Gelatin | | 1.10 |
| Nineth Layer (third green-sensitive emulsion layer) | | |
| Silver iodobromide emulsion (Silver iodide 12 mol %, average grain diameter 1.0 μm) | Silver | 1.2 |
| Sensitization Dye V | | $3.5 \times 10^{-5}$ |
| Sensitization Dye VI | | $8.0 \times 10^{-5}$ |
| Sensitization Dye VII | | $3.0 \times 10^{-4}$ |
| EX-6 | | 0.065 |
| EX-11 | | 0.030 |
| EX-1 | | 0.025 |
| HBS-1 | | 0.25 |
| HBS-2 | | 0.10 |
| Gelatin | | 1.74 |
| Tenth Layer (yellow filter layer) | | |

-continued

| | | |
|---|---|---|
| Yellow Colloidal Silver | Silver | 0.05 |
| EX-5 | | 0.08 |
| HBS-3 | | 0.03 |
| Gelatin | | 0.95 |
| Eleventh Layer (first blue-sensitive emulsion layer) | | |
| Silver iodobromide emulsion (Silver iodide 6 mol %, average grain diameter 0.6 μm) | Silver | 0.24 |
| Sensitization Dye VIII | | $3.5 \times 10^{-4}$ |
| EX-9 | | 0.85 |
| EX-8 | | 0.12 |
| HBS-1 | | 0.28 |
| Gelatin | | 1.28 |
| Twelfth Layer (second blue sensitive emulsion layer) | | |
| Silver iodobromide emulsion (Silver iodide 10 mol %, average grain diameter 0.8 μm) | Silver | 0.45 |
| Sensitization Dye VIII | | $2.1 \times 10^{-4}$ |
| EX-9 | | 0.20 |
| EX-10 | | 0.015 |
| HBS-1 | | 0.03 |
| Gelatin | | 0.46 |
| Thirteenth Layer (third red-sensitive emulsion layer) | | |
| Silver iodobromide emulsion (Silver iodide 14 mol %, average grain diameter 1.3 μm) | Silver | 0.77 |
| Sensitization Dye VIII | | $2.2 \times 10^{-4}$ |
| EX-9 | | 0.20 |
| HBS-1 | | 0.07 |
| Gelatin | | 0.69 |
| Fourteenth Layer (first protective layer) | | |
| Silver iodobromide emulsion (Silver iodide 1 mol %, average grain diameter 0.07 μm) | Silver | 0.5 |
| U-4 | | 0.11 |
| U-5 | | 0.17 |
| HBS-1 | | 0.90 |
| Gelatin | | 1.00 |
| Fifteenth Layer (second protective layer) | | |
| Polymethylmethacrylate grains (diameter about 1.5 μm) | | 0.54 |
| S-1 | | 0.15 |
| S-2 | | 0.05 |
| Gelatin | | 0.72 |

In addition to the components noted above, Gelatin Hardening Agent H-1 and a surfactant were added to each layer.

U-1

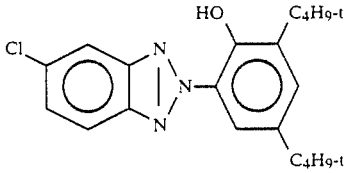

U-2

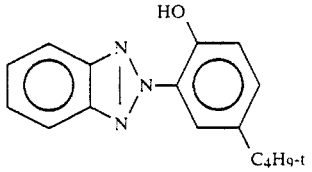

U-3

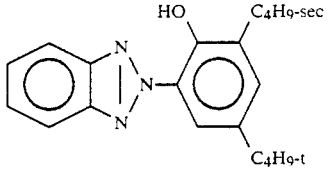

U-4

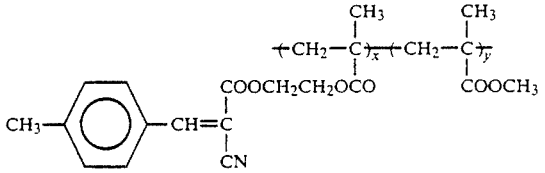

x/y = 7/3 (weight ratio)
MW = about 30,000

U-5

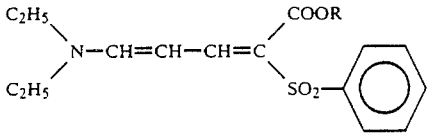

R = $C_8H_{17}$

EX-1

-continued
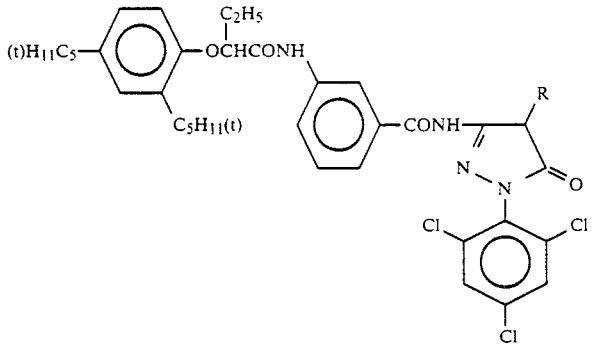
where R = 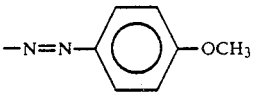
EX-2
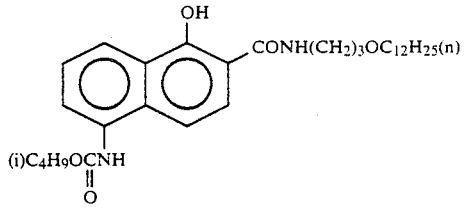
EX-3
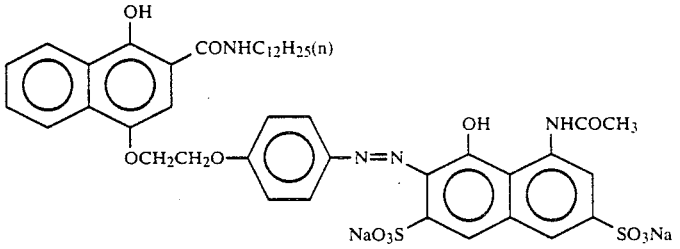
EX-4
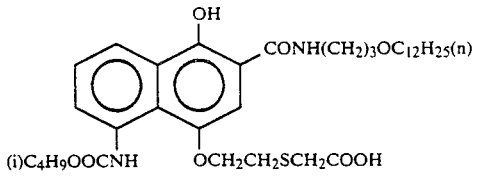
EX-5
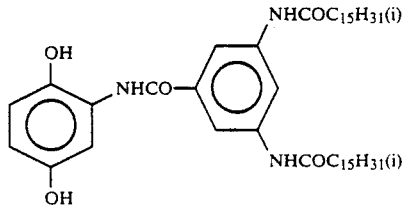
EX-6

-continued
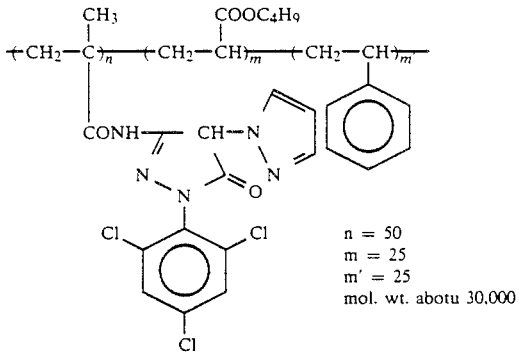
EX-7
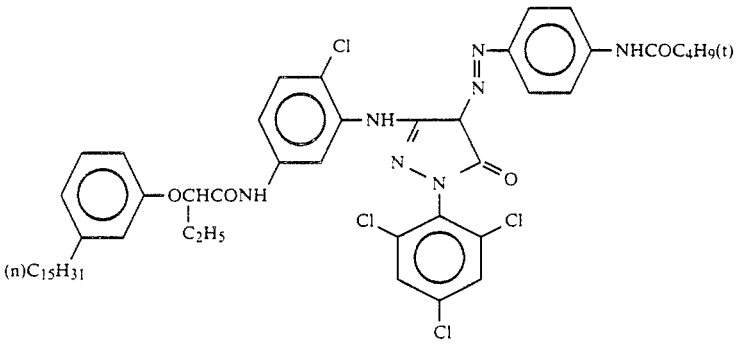
EX-8
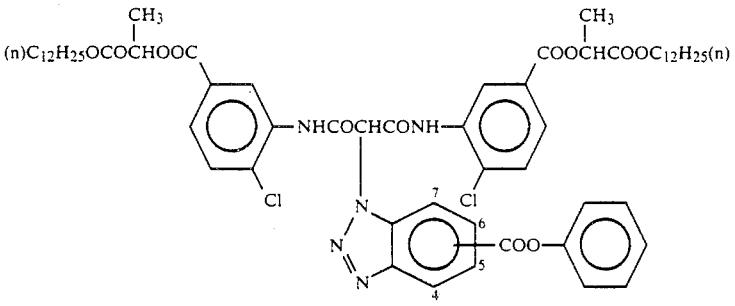
EX-9
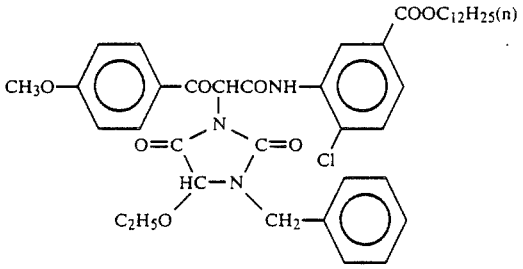
EX-10

-continued
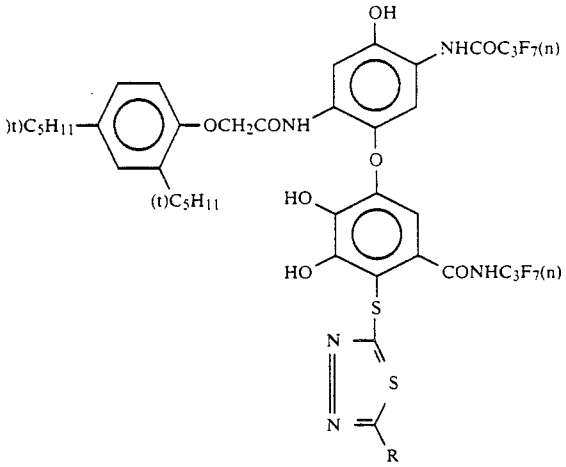
R = $SCHCOOCH_3$
|
$CH_3$
EX-11:same as EX-1
but R = H
EX-12
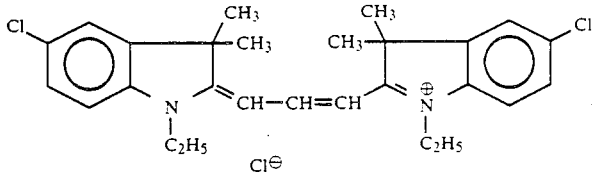
S-1
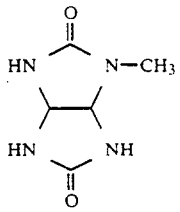
S-2
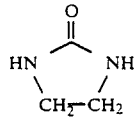
HSB-1:
Tricresyl phosphate
HSB-2:
Dibutyl phthalate
HSB-3:
Bis(2-ethylhexyl)phthalate
HSB-4
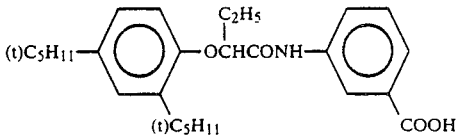
H-1
$CH_2{=}CH{-}SO_2{-}CH_2{-}CONH{-}CH_2$
$CH_2{=}CH{-}SO_2{-}CH_2{-}CONH{-}CH_2$

SENSITIZATION DYES

I

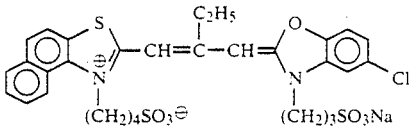

II

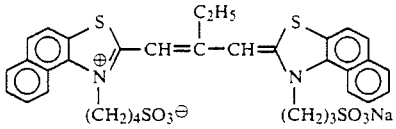

III

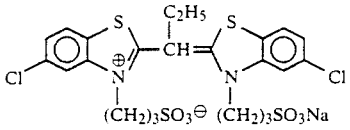

IV

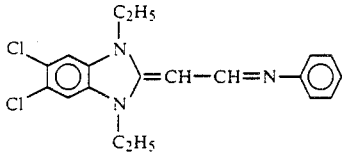

V

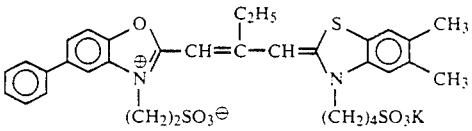

VI

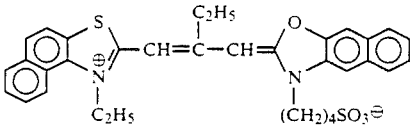

VII

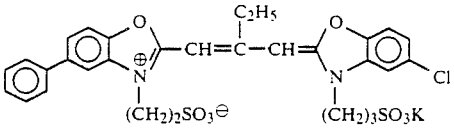

VIII

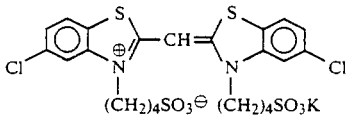

IX

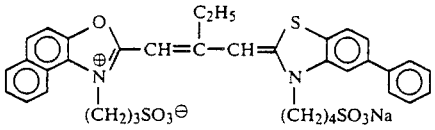

Samples 2-A and 2-B in which the average aspect ratios of 95 to 100% (occupying ratio of the projected area of the grains selected as described hereinbefore) of the total of the silver halide grains in the silver halide grains in the emulsions used in the various layers were varied in the manner shown in Table 3 below were prepared. In all the samples, the hydrophilic colloid layer thickness was 22 μm.

TABLE 3

| Layer | 2-A | 2-B |
|---|---|---|
| 3rd | 2.5 | 5.5 |
| 4th | 2.5 | 5.5 |
| 5th | 2.5 | 5.5 |
| 7th | 3.0 | 6.0 |
| 8th | 3.5 | 6.5 |
| 9th | 3.5 | 6.5 |
| 11th | 4.0 | 5.7 |
| 12th | 3.5 | 5.8 |
| 13th | 3.0 | 6.0 |

The samples thus produced were processed with processing solutions that had different bromine ion concentrations, as in Example 1, and the magenta ΔDmin (change in minimum density), ΔS (change in sensitivity, change in log E value with an increase from Dmin to 0.1) and ΔH (gradation change, density change in terms of log E on the 0.5 high exposure side relative to the sensitivity point). The results obtained are shown in Table 4 below.

TABLE 4

| Sample | KBr (mol/l) | Remarks | | Initial | 10th | 20th |
|---|---|---|---|---|---|---|
| 2-A | $5.5 \times 10^{-3}$ | Comparison example | ΔDmin | 0 | −0.05 | −0.07 |
| | | | ΔS | 0 | −0.03 | −0.04 |
| | | | ΔH | 0 | +0.04 | +0.07 |
| | $12 \times 10^{-3}$ | Comparison example | ΔDmin | 0 | −0.03 | −0.04 |
| | | | ΔS | 0 | −0.02 | −0.03 |
| | | | ΔH | 0 | +0.03 | −0.04 |
| | $13.5 \times 10^{-3}$ | Comparison example | ΔDmin | 0 | −0.05 | −0.06 |
| | | | ΔS | 0 | −0.03 | −0.04 |
| | | | ΔH | 0 | +0.04 | −0.06 |
| 2-B | $5.5 \times 10^{-3}$ | Comparison example | ΔDmin | 0 | −0.04 | −0.06 |
| | | | ΔS | 0 | −0.03 | −0.04 |
| | | | ΔH | 0 | +0.04 | +0.06 |
| | $12 \times 10^{-3}$ | The invention | ΔDmin | 0 | −0.01 | −0.01 |
| | | | ΔS | 0 | −0.01 | −0.01 |
| | | | ΔH | 0 | +0.02 | +0.02 |
| | $13.5 \times 10^{-3}$ | Comparison example | ΔDmin | 0 | −0.03 | −0.05 |
| | | | ΔS | 0 | −0.03 | −0.04 |
| | | | ΔH | 0 | +0.04 | +0.07 |

In the invention, there was little change in the minimum density, sensitivity or gradation and good photographic characteristics were achieved in continuous processing.

Thus the present invention makes it possible to achieve a stabilized excellent performance (especially with respect to sensitivity and gradation) in a waste development solution regeneration system using ion exchange membrane electrodialysis.

Further, there is, in particular, stabilization in the fluctuation of photographic characteristics during continuous processing when photographic materials whose coated silver quantity is 2 to 6 g/m² are processed and when the hydrophilic colloid layer thickness is 23 μm or less.

While the invention has been described in detail and with reference to specific embodiments thereof, it will be apparent to one skilled in the art that various changes and modifications can be made therein without departing from the spirit and scope thereof.

What is claimed is:

1. A method of processing a silver halide color photographic material while regenerating the color development solution by ion exchange membrane electrodialysis comprising developing an image-wise exposed silver halide photographic material comprising a support having thereon at least one layer of a silver halide emulsion wherein silver halide grains which occupy 50% or more of the projected area of the total of the silver halide grains in the emulsion and which are selected in the order of decreasing aspect ratio from the largest aspect ratio, have an average aspect ratio of 5 or more with a developing solution, and subjecting the development solution to a regeneration using ion-exchange membrane electrodialysis where the equilibrium concentration of bromine ions in the development solution is controlled at a level within the range of $6.0\times10^{-3}$ to $1.3\times10^{-2}$ mol/l.

2. The method as claimed in claim 1, wherein said bromine ion concentration is controlled at a level within the range of $8\times10^{-3}$ to $1.2\times10^{-2}$ mol/l.

3. The method as claimed in claim 1, wherein said silver halide grains comprise silver iodobromide, silver bromide, silver chlorobromide, or silver bromochloroiodide.

4. The method as claimed in claim 1, wherein said silver halide grains comprise silver iodobromide grains containing 0.1 to 20 mol % of silver iodide.

5. The method as claimed in claim 1, wherein the average aspect ratio of said silver halide grains is 8 or more.

6. The method as claimed in claim 1, wherein the coated silver quantity of the silver halide photographic material is 2 to 6 g/m$^2$.

7. The method as claimed in claim 1, wherein the thickness of all of the hydrophilic colloid layers of the silver halide photographic material is 23 μm or less.

8. The method as claimed in claim 1, wherein said silver halide grains occupy 70% or more of the projected area of the total of the silver halide grains in the emulsion and have an average aspect ratio of 5 or more.

9. The method as claimed in claim 1, wherein said silver halide grains occupy 90% or more of the projected area of the total of the silver halide grains in the emulsion and have an average aspect ratio of 5 or more.

10. The method as claimed in claim 1, wherein said silver halide grains occupy 95 to 100% of the projected area of the total of the silver halide grains in the emulsion and have an average aspect ratio of 5 or more.

11. The method as claimed in claim 1, wherein said silver halide photographic material comprises a support having thereon at least one blue sensitive silver halide emulsion layer, at least one green sensitive silver halide emulsion layer and at least one red sensitive silver halide emulsion layer.

12. The method as claimed in claim 1, wherein at least a half of all of the emulsion layers comprise said emulsion layers.

13. The method as claimed in claim 1, wherein at least one of blue-sensitive layers and green sensitive layers comprise said emulsion layers.

14. The method as claimed in claim 1, wherein a higher-speed layer of a unit of the emulsion layers having the same color sensitivity comprises said emulsion layer.

15. The method as claimed in claim 1, wherein the average diameter of said silver halide grains is 0.25 to 2.8 μm.

16. The method as claimed in claim 1, wherein the average thickness of said silver halide grains is 0.56 μm or less.

17. The method as claimed in claim 16, wherein the average thickness of said silver halide grains is at least 0.01 μm.

18. The method as claimed in claim 1, wherein the electrical current density for the ion exchange membrane electrodialysis is 0.2 to 10 A/dm$^2$.

19. The method as claimed in claim 1, wherein the development solution contains a aromatic primary amine color developer.

20. The method as claimed in claim 1, wherein the development solution has a pH of 9 to 12.

* * * * *